US011150584B2

(12) United States Patent
Kawashima

(10) Patent No.: US 11,150,584 B2
(45) Date of Patent: Oct. 19, 2021

(54) IMAGE FORMING APPARATUS AND BOARD

(71) Applicant: FUJIFILM BUSINESS INNOVATION CORP., Tokyo (JP)

(72) Inventor: Shimpei Kawashima, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 219 days.

(21) Appl. No.: 16/293,143

(22) Filed: Mar. 5, 2019

(65) Prior Publication Data

US 2020/0096923 A1 Mar. 26, 2020

(30) Foreign Application Priority Data

Sep. 25, 2018 (JP) ..... JP2018-179556
Sep. 25, 2018 (JP) ..... JP2018-179571

(51) Int. Cl.
*G03G 15/00* (2006.01)

(52) U.S. Cl.
CPC ..... *G03G 15/50* (2013.01)

(58) Field of Classification Search
None
See application file for complete search history.

(56) References Cited

U.S. PATENT DOCUMENTS 5,504,924 A * 4/1996 Ohashi ..... F28D 15/0233 361/676
9,349,681 B1 * 5/2016 Kelly ..... H01L 23/49827
2002/0008314 A1 1/2002 Takeuchi
2009/0322437 A1 * 12/2009 Avni ..... H01L 25/16 331/158

FOREIGN PATENT DOCUMENTS

JP 2000-307005 A 11/2000
JP 2011-088292 A 5/2011

* cited by examiner

*Primary Examiner* — Angel Roman
(74) *Attorney, Agent, or Firm* — Oliff PLC

(57) ABSTRACT

An image forming apparatus includes: a board; a semiconductor integrated circuit that is provided on the board and has a real-time clock circuit; a radiator that is provided at a position for covering the semiconductor integrated circuit and receives heat from the semiconductor integrated circuit and radiates the heat; and an oscillator that is provided in a space sandwiched between the board and the radiator and vibrates to supply a clock signal to the real-time clock circuit.

12 Claims, 13 Drawing Sheets

IMAGE FORMING APPARATUS AND BOARD

CROSS-REFERENCE TO RELATED APPLICATIONS

This application is based on and claims priority under 35 USC 119 from Japanese Patent Application No. 2018-179571 filed Sep. 25, 2018 and Japanese Patent Application No. 2018-179556 filed Sep. 25, 2018.

BACKGROUND

(i) Technical Field

The present disclosure relates to an image forming apparatus and a board.

(ii) Related Art

JP-A-2011-88292 discloses that a main control unit recognizes a time point at every preset time interval or at every preset date and time in an operation state in which the main control unit shifts itself to a power saving state, thereby restarting a CPU using a program stored in a ROM, and causing the CPU to execute an initial setting process for contents stored in the RAM.

JP-A-2000-307005 discloses that ground electrode pads and a power supply electrode pads are arranged so as to face each other in a concentrated manner in a central portion of a semiconductor integrated circuit mounted on a printed wiring board, and the electrode pads are respectively connected to each other by a wiring pattern. It is also disclosed that a decoupling capacitor in which electrodes are connected to the electrode pads for ground and power supply via through-holes is mounted on an opposite surface of the printed wiring board at a position corresponding to the electrode pads for ground and power supply.

For example, in a board provided in an image forming apparatus or the like, a semiconductor integrated circuit having a real-time clock circuit and an oscillator for supplying a clock signal to the semiconductor integrated circuit may be provided. Here, since the oscillator is generally highly sensitive to a change in capacitance, an oscillation frequency can also fluctuate by, for example, a human body touching the oscillator. Therefore, a structure in which the oscillator is covered with a tape is adopted to protect the oscillator, but in this case, an operation of providing the tape is necessary in a manufacturing process.

Along with an increase in a function required for a semiconductor integrated circuit, plural elements having different magnitudes of transient current fluctuations, such as different operating frequencies, may be provided for one semiconductor integrated circuit. In a board on which such a semiconductor integrated circuit is mounted, it is required to apply plural power supply voltages to the semiconductor integrated circuit. Here, in order to reduce fluctuations in the power supply voltage applied to the semiconductor integrated circuit, for example, the line width of a rectangular terminal for applying the power supply voltage may be increased. However, for example, arrangement of plural terminals with a widened line width will increase the wiring area.

SUMMARY

Aspects of non-limiting embodiments of the present disclosure relate to protecting an oscillator while making a manufacturing process simpler than that used when an oscillator-protecting tape is provided.

Aspects of non-limiting embodiments of the present disclosure also relate to making smaller the wiring area for applying a power supply voltage to a semiconductor integrated circuit including plural elements having different magnitudes of transient current fluctuations than that for applying a power supply voltage to such a semiconductor integrated circuit via a rectangular terminal.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided an image forming apparatus including: a board; a semiconductor integrated circuit that is provided on the board and has a real-time clock circuit; a radiator that is provided at a position for covering the semiconductor integrated circuit and receives heat from the semiconductor integrated circuit and radiates the heat; and an oscillator that is provided in a space sandwiched between the board and the radiator and vibrates to supply a clock signal to the real-time clock circuit.

BRIEF DESCRIPTION OF THE DRAWINGS

Exemplary embodiments of the present invention will be described in detail based on the following figures, wherein.

DETAILED DESCRIPTION

First Exemplary Embodiment

Hereinafter, a first exemplary embodiment of the present disclosure will be described with reference to accompanying drawings.

Image Forming Apparatus 1

Figure 1:
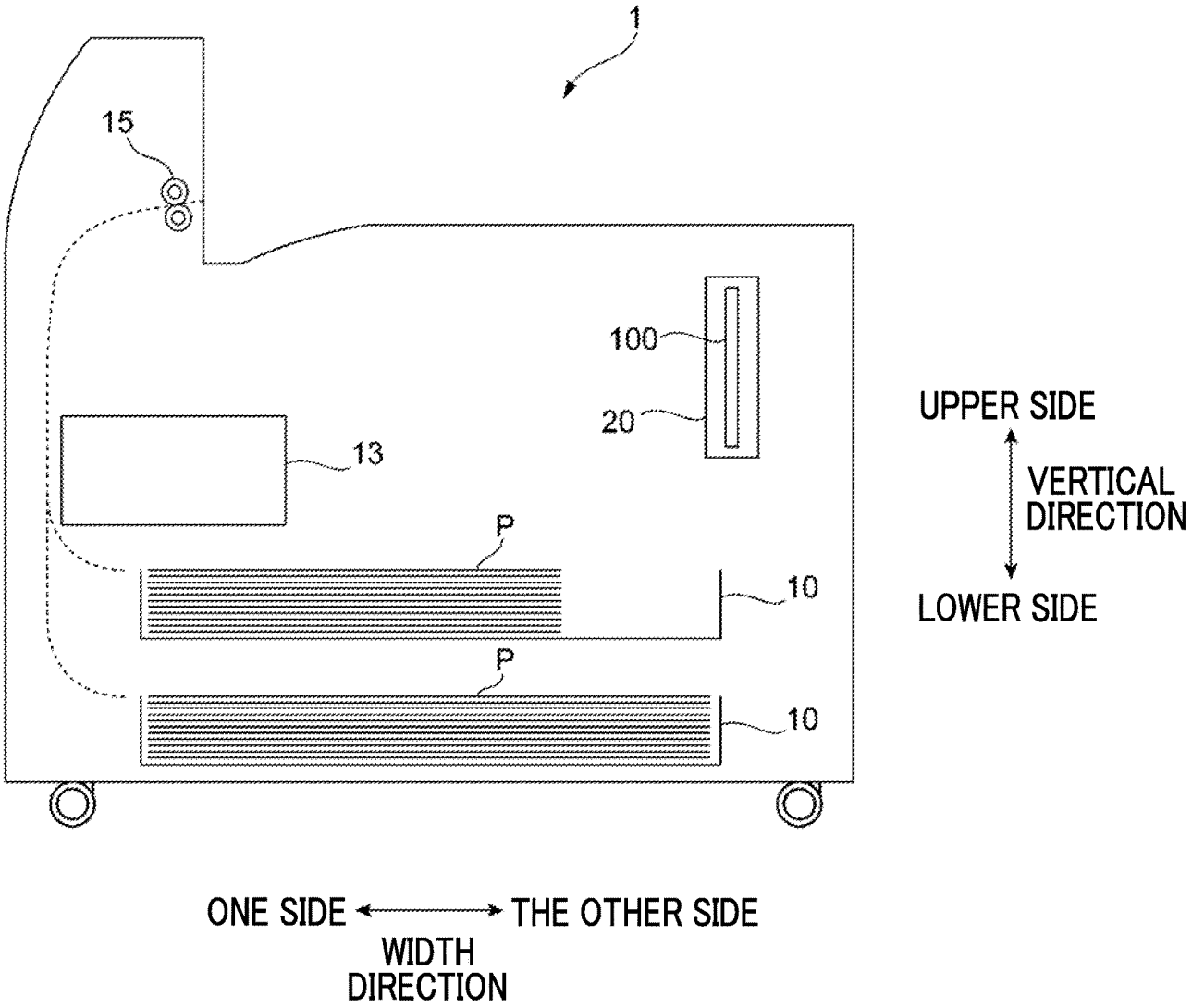
FIG. 1 is a diagram showing a configuration of an image forming apparatus to which the present exemplary embodiment is applied.

FIG. 1 is a diagram showing a configuration of an image forming apparatus 1 to which the present exemplary embodiment is applied.

First, a configuration of an image forming apparatus 1 to which the present exemplary embodiment is applied will be described with reference to FIG. 1.

The image forming apparatus 1 forms an image on a recording material such as a sheet P, that is, a sheet. The image forming apparatus 1 shown in the drawing includes a sheet accommodating unit 10 accommodating the sheet P, an image forming unit 13 forming an image on the sheet P, a discharge roller 15 discharging the sheet P on which an image is formed, and a control unit 20 controlling an operation of the image forming apparatus 1.

In the following description, an upward and downward direction, that is, a vertical direction in the image forming apparatus 1 shown in FIG. 1 may be simply referred to as the "vertical direction". An upper side in the vertical direction in FIG. 1 may be simply referred to as the "upper side", and a lower side in the vertical direction may be simply referred to as the "lower side". A horizontal direction of the drawing in the image forming apparatus 1 shown in FIG. 1 may be simply referred to as a "width direction". Also, a left side of the drawing in FIG. 1 may be simply referred to as "one side", and a right side of the drawing may be simply referred to as "the other side". A depth direction of the drawing in the image forming apparatus 1 shown in FIG. 1 may be simply referred to as a "depth direction". In addition, a front side of the drawing in FIG. 1 may be simply referred to as a "front side" and a back side of the drawing may be simply referred to as a "back side" (see FIG. 2).

The sheet accommodating unit 10 accommodates sheets P of different sizes and types. In the illustrated example, plural sheet accommodating units 10 are provided. Each of the sheet accommodating units 10 can be pulled out toward the front side in the depth direction.

The image forming unit 13 forms an image on the sheet P transported from the sheet accommodating unit 10. The image forming unit 13 forms an image on the sheet P by an electrophotographic system in which a toner adhered to a photoconductor is transferred onto the sheet P to form an image. A method of forming an image by the image forming unit 13 is not particularly limited, and an image may be formed by an inkjet method of forming an image by ejecting ink onto the sheet P.

The discharge roller 15 discharges the sheet P on which the image is formed by the image forming unit 13. The discharge roller 15 in the illustrated example is composed of a pair of rollers, and as the pair of rollers rotates, the sheet P is discharged from the image forming apparatus 1.

The control unit 20 controls the operation of each component provided in the image forming apparatus 1. The control unit 20 includes a control board 100. The control board 100 in the illustrated example is provided on a surface of the other side in the width direction of the image forming apparatus 1, and a plate surface is arranged along the vertical direction.

The operation of the image forming apparatus 1 will be described. First, as an instruction signal is output from the control unit 20, the sheet P is fed one by one from the sheet accommodating unit 10. After the image is formed on the sheet P by the image forming unit 13, the sheet P on which the image is formed is discharged by the discharge roller 15.

Control Board 100

Figure 2:
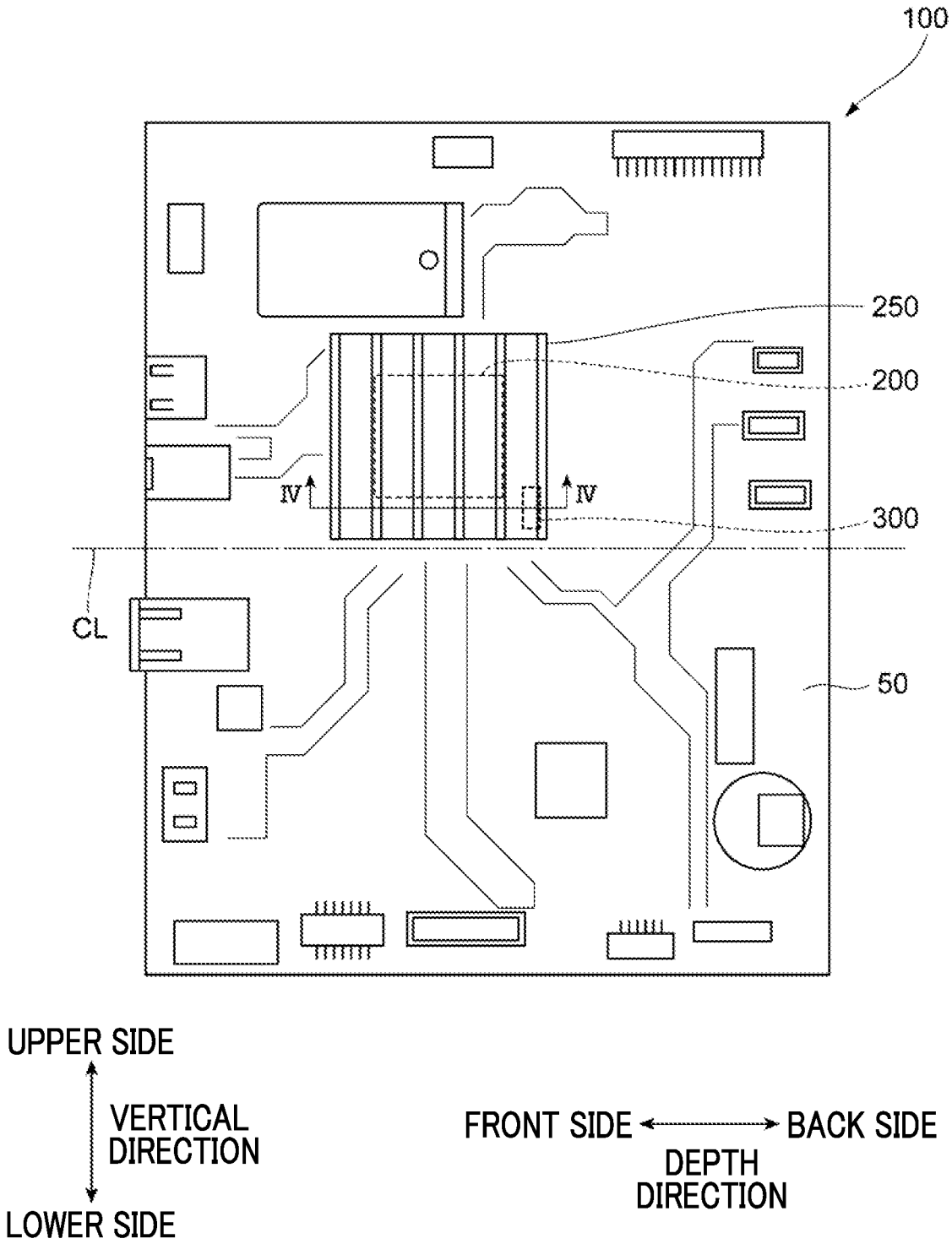
FIG. 2 is a diagram illustrating a schematic configuration of a control board.

FIG. 2 is a diagram illustrating a schematic configuration of the control board 100.

The schematic configuration of the control board 100 will be described with reference to FIG. 2.

As shown in FIG. 2, the control board 100 includes a board main body 50 which is a so-called printed circuit board formed of a glass-epoxy board or the like, and a system on a chip (SoC) 200 which is one of elements mounted on the board main body 50. In the illustrated example, the SoC 200 is provided above a center CL in the vertical direction of the board main body 50.

Here, the SoC 200 is an exemplary semiconductor integrated circuit, and is a single semiconductor chip that performs plural functions required for the operation of the image forming apparatus 1. The illustrated SoC 200 includes plural CPUs and includes real-time clock circuits. Here, the SoC 200 is described as one of the elements mounted on the board main body 50, but plural elements including the SoC 200 are mounted on the board main body 50. The element mounted on the board main body 50 may include, for example, a main control element such as a hard disk, a central processing unit (CPU), a memory, or the like, an external connection element such as a facsimile or a universal serial bus (USB) device that connects to an external device of the image forming apparatus 1, or a voltage supply element including a high voltage core power supply (for example, 1.1 V) and a low voltage core power supply (for example, 0.9 V).

Peripheral Configuration of SoC 200

Figure 3:
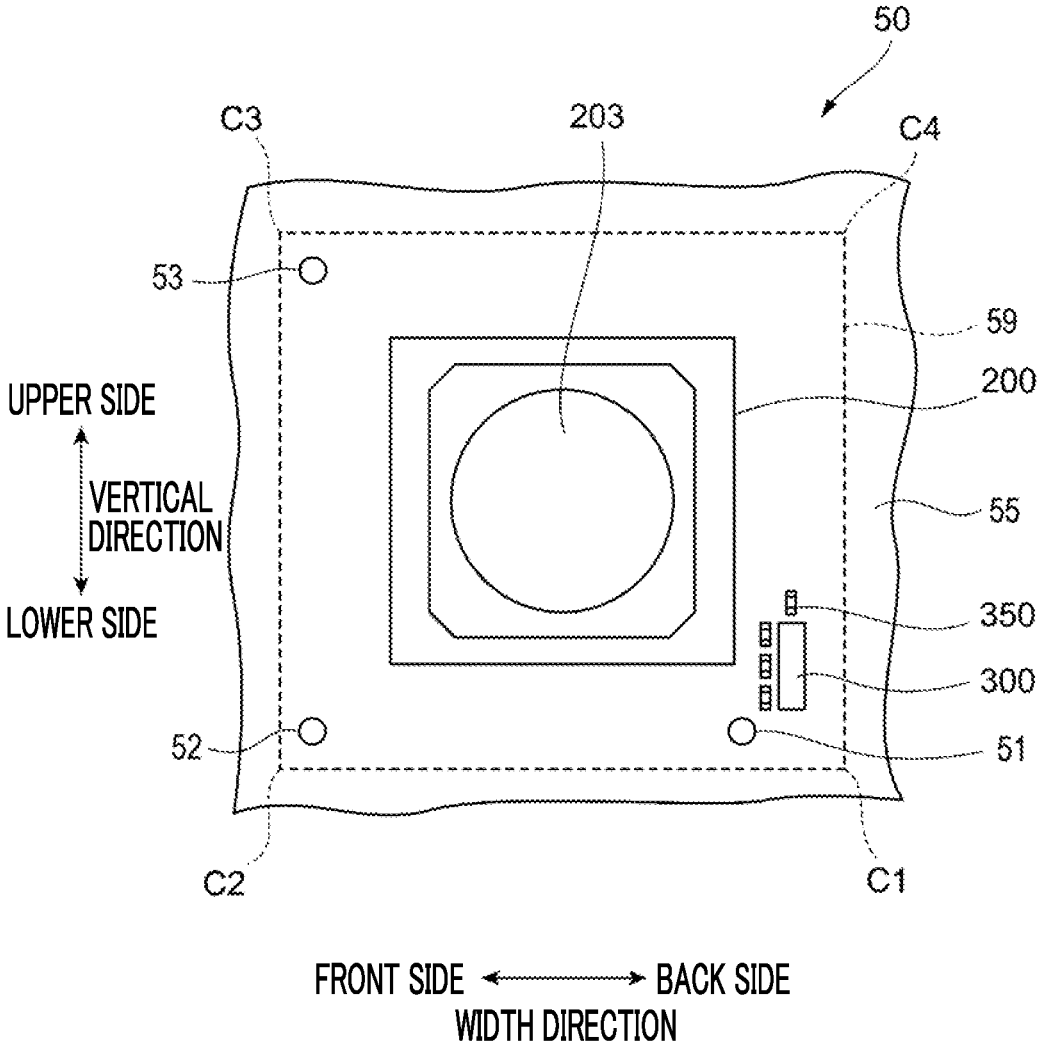
FIG. 3 is a diagram illustrating a peripheral configuration of a SoC.

FIG. 3 is a diagram illustrating a peripheral configuration of the SoC 200. In FIG. 3, a description of a heat sink 250 is omitted.

Figure 4:
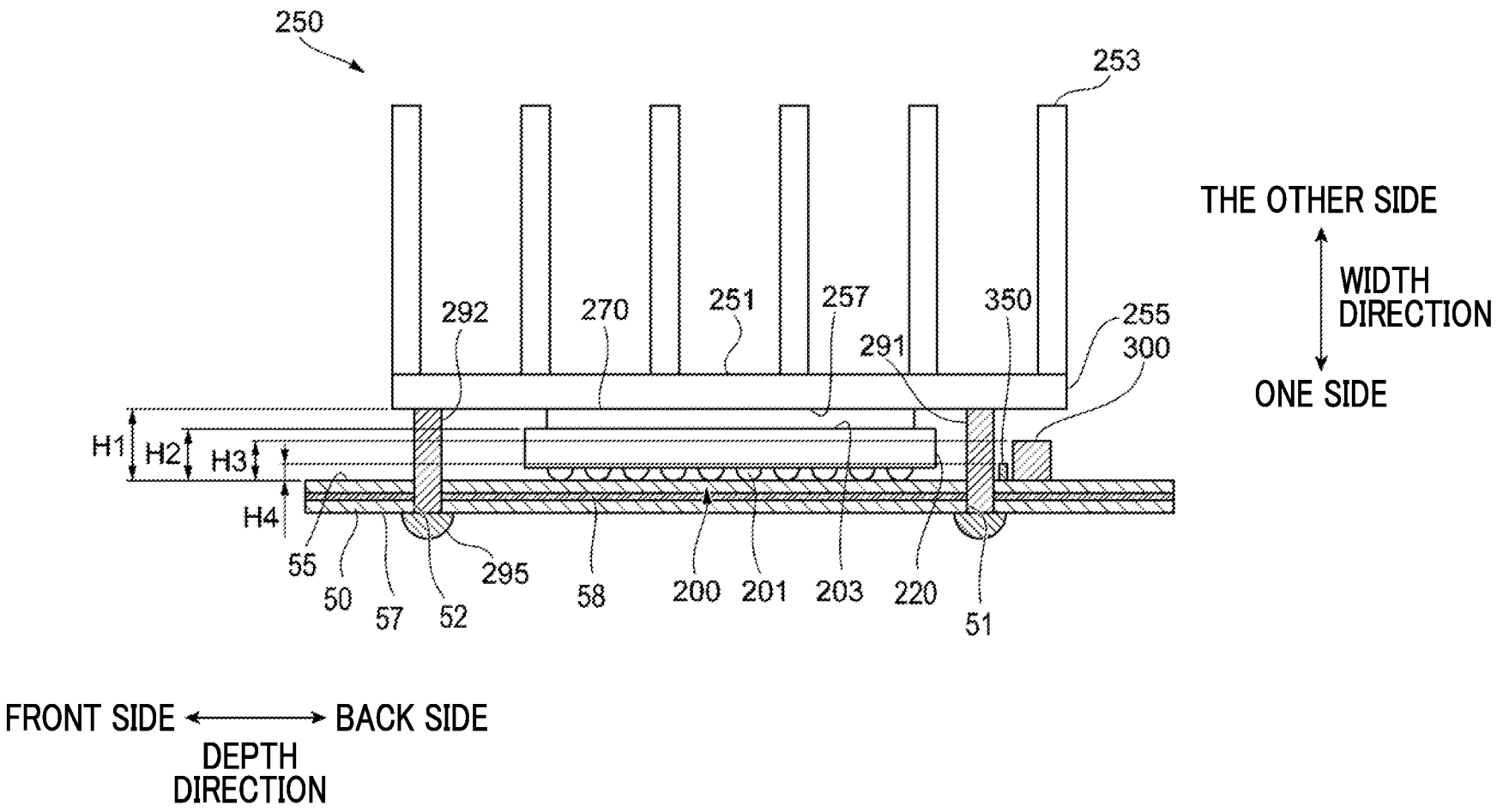
FIG. 4 is a cross-sectional view taken along a line IV-IV of FIG. 2.

FIG. 4 is a cross-sectional view taken along a line IV-IV of FIG. 2.

Next, referring to FIGS. 3 and 4, the SoC 200 and the peripheral configuration thereof will be described.

As shown in FIGS. 3 and 4, the SoC 200 is mounted on the board main body 50. In addition, the periphery of the SoC 200 includes a heat sink 250 (see FIG. 4) for radiating heat generated in the SoC 200, a quartz crystal oscillator 300 for generating a clock signal transmitted to the SoC 200, and a capacitor 350 for stabilizing the clock signal generated by the quartz crystal oscillator 300. After the board main body 50 is described below, each of the SoC 200, the heat sink 250, the quartz crystal oscillator 300, and the capacitor 350 will be described.

First, the board main body 50 will be described. The board main body 50 has a first surface 55 on which the SoC 200 is mounted, and a second surface 57 opposite to the first surface 55 (see FIG. 4). Here, a region on the first surface 55 of the board main body 50, facing the heat sink 250, is defined as a heat sink facing region 59. In the illustrated example, the heat sink facing region 59 is a substantially rectangular region on the first surface 55 of the SoC 200.

The board main body 50 includes a first through-hole 51, a second through-hole 52, and a third through-hole 53, which are plural through-holes, in the heat sink facing region 59. The first through-hole 51 to the third through-hole 53 are provided at four corners of the heat sink facing region 59, that is, at some corners of the first corner portion C1 to the fourth corner portion C4, that is, at three corner portions of the first corner portion C1 to the third corner portion C3.

The board main body 50 is formed by stacking plural layers. To explain further, the board main body 50 includes a ground layer 58 (see FIG. 4) as an intermediate layer, which is provided to be grounded. A board terminal (not shown), which is a terminal electrically connected to the SoC 200, is provided on the first surface 55 of the board main body 50.

Next, the SoC 200 will be described. The SoC 200 includes a flat SoC board 220 having plural CPUs and the like provided therein, and a SoC terminal 201 provided in the SoC board 220 and electrically connected to a board terminal (not shown) of the board main body 50. Here, a heat sink 250 is fixed to a top surface 203 of the SoC board 220, which is a surface opposite to the SoC terminal 201.

Next, the heat sink 250 will be described. The heat sink 250 has a flat sink base body 251 provided on the top surface 203 of the SoC board 220, and plural fin plates 253 provided in a rising direction from the sink base body 251. As illustrated, the fin plates 253 each have a surface oriented in the vertical direction. The fin plates 253 are arranged at predetermined intervals in the depth direction. In the following description, in a state in which the heat sink 250 is provided on the SoC board 220, an end portion of the sink base body 251 on the back side in the depth direction may be referred to as a back side end 255, and an end portion of the sink base body 251 on the lower side in the vertical direction may be referred to as a lower side end 256 (see FIG. 5 to be described later).

The heat sink 250 is fixed to the SoC 200 via an adhesive body 270. The illustrated adhesive body 270 is formed of a sheet member, for example, a heat conduction tape for bonding the top surface 203 of the SoC board 220 and a bottom surface 257 of the sink base body 251. The bottom surface 257 of the heat sink 250 is larger than the top surface 203 of the SoC board 220, and the bottom surface 257 of the heat sink 250 is in a positional relationship for covering the top surface 203 of the SoC board 220. A portion of the bottom surface 257 of the heat sink 250 protruding to an outer periphery of the top surface 203 of the SoC board 220 is fixed via plural struts. In the illustrated example, the sink base body 251 of the heat sink 250 and the board main body 50 are connected by the first strut 291, the second strut 292, and the third strut 293.

Here, one end of each of the first to third struts 291 to 293 is fixed to the sink base body 251, and the other end thereof is fixed to the board main body 50. Each of the first to third struts 291 to 293 is provided so as to pass through the first to third through-holes 51 to 53, and is fixed to the board main body 50 by solder 295 on the side of the second surface 57.

Next, the quartz crystal oscillator 300 will be described. The quartz crystal oscillator 300 has a substantially rectangular parallelepiped shape, and is provided on the first surface 55 together with the heat sink 250. Specifically, the quartz crystal oscillator 300 is provided in the first corner portion C1 in the heat sink facing region 59. That is, the quartz crystal oscillator 300 is provided below an outer periphery of the heat sink 250. The illustrated quartz crystal oscillator 300 is provided so that a longitudinal direction of the quartz crystal oscillator 300 is along the vertical direction (see FIG. 5 to be described later).

Next, the capacitor 350 will be described. The capacitor 350 has a substantially rectangular parallelepiped shape and is provided on the first surface 55 together with the heat sink 250. Specifically, the capacitor 350 is provided in the first corner portion C1 in the heat sink facing region 59. That is, the capacitor 350 is provided below the outer periphery of the heat sink 250. Plural capacitors 350 in the illustrated example are provided around the quartz crystal oscillator 300. The capacitor 350 is provided so that a longitudinal direction of the capacitor 350 is along the vertical direction (see FIG. 5 to be described later).

Arrangement of Quartz Crystal Oscillator 300 and Capacitor 350

The real-time clock circuit included in the SoC 200 is generally highly sensitive to a change in capacitance of a clock generation oscillator peripheral circuit such as the quartz crystal oscillator 300 and the capacitor 350. Therefore, a change in capacitance due to the quartz crystal oscillator 300, the capacitor 350, and the like being touched by the human body may cause the stop of the clock vibration. In addition, the oscillation frequency may fluctuate as the temperature of the quartz crystal oscillator 300 fluctuates.

In general, a clock function can be reset when a time lag is generated in the clock function due to the stop of oscillation or the like. However, in the image forming apparatus 1, in order to prevent improprieties from occurring in response to security and accounting, the time setting of a master clock (Coordinated Universal Time (UTC)) cannot be changed in a place other than a manufacturing plant. Therefore, the stop of the clock function leads to replacement of the control board 100, thereby causing a disadvantage to a user and increasing the service cost.

In order to prevent a malfunction in the real-time clock circuit as described above, the quartz crystal oscillator 300 and the capacitor 350 may not be disposed in the vicinity of a heating element in the design stage. For example, in an example different from the present exemplary embodiment, the quartz crystal oscillator 300 and the capacitor 350 may be disposed on a surface of the board opposite to a mounting surface on which the heating element is mounted.

Further, in order to prevent contact with the human body at a time of replacing a board or the like, the quartz crystal oscillator 300 and the capacitor 350 may be covered with a tape. Although a cover using a protective component such as a tape can prevent a malfunction, it causes an increase in production cost due to an addition of a manufacturing process. Therefore, in the present exemplary embodiment, the quartz crystal oscillator 300 and the capacitor 350 are prevented from touching the human body and the clock function is protected without using the tape as the protective component.

Specifically, as shown in FIGS. 3 and 4, the quartz crystal oscillator 300 and the capacitor 350 are provided in a space occupied by the heat sink 250. In other words, the quartz crystal oscillator 300 and the capacitor 350 are provided directly under the heat sink 250. In the illustrated example, the quartz crystal oscillator 300 and the capacitor 350 are provided on the front side in the depth direction with respect to the back side end 255 of the heat sink 250, and on the upper side in the vertical direction with respect to the lower side end 256 of the heat sink 250 (see FIG. 5 to be described later). As a result, the quartz crystal oscillator 300 and the capacitor 350 are structurally prevented from touching the human body by using the heat sink 250 configured to cool the SoC 200 serving as the heating element.

Here, regarding the height from the first surface 55 of the board main body 50 as shown in FIG. 4, the height H3 of the quartz crystal oscillator 300 is smaller than the height H2 of the SoC 200. The height H4 of the capacitor 350 is smaller than the height H2 of the SoC 200. Thus, a gap is formed between the sink base body 251 of the heat sink 250 and the quartz crystal oscillator 300 and the capacitor 350, which reduces transfer of heat from the heat sink 250.

In the illustrated example, the heights H1, H2, H3, and H4 are lower in this order. For example, the height H1 is 4 mm, the height H2 is 3 mm, the height H3 is 2 mm, and the height H4 is 1 mm. Here, the height H1, which is the distance from the first surface 55 of the board main body 50 to the bottom surface 257 of the sink base body 251, is a dimension that prevents the user's finger tip from entering between the first surface 55 of the board main body 50 and the bottom surface 257 of the sink base body 251.

As described above, the heat sink 250 is supported by the first to third struts 291 to 293. That is, the outer periphery of the heat sink 250 is supported by three points. The position of the sink base body 251 is uniquely determined by the support of the three points. Here, unlike the illustrated example, when the heat sink 250 is fixed at four points, the position of the sink base body 251 is not uniquely fixed, and the heat sink 250 may rattle due to variations in the length of the struts supporting the respective points. Such rattling of the heat sink 250 is prevented in the illustrated configuration supporting the heat sink 250 at three points.

The first strut 291 is provided at the first corner portion C1 of the heat sink facing region 59 in which the quartz crystal oscillator 300 is provided. By providing the first strut 291, even if an external force is applied to the heat sink 250 such that the distance of the bottom surface 257 of the sink base body 251 from the first surface 55 of the board main body 50 changes, for example, a movement of the heat sink 250 is prevented by the first strut 291. To explain further, the first strut 291 prevents the sink base body 251 from coming into contact with the quartz crystal oscillator 300.

The first to third struts 291 to 293 supporting the heat sink 250 pass through the board main body 50 and are provided so as to connect with the ground layer 58. As a result, the heat of the illustrated heat sink 250 is transferred to the ground layer 58 via the first to third struts 291 to 293, and is radiated from the ground layer 58.

Arrangement in Heat Sink Facing Region 59

Figure 5:
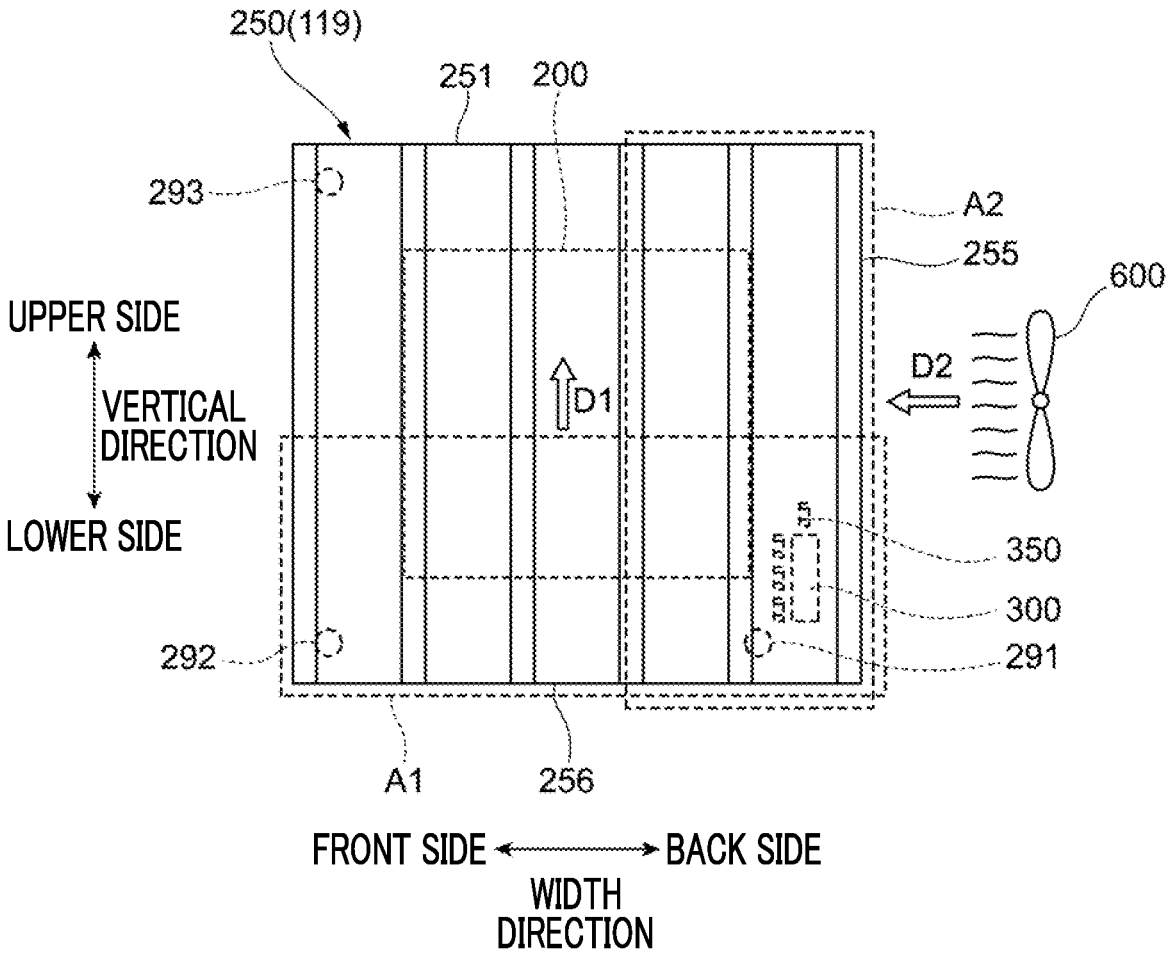
FIG. 5 is a diagram showing an arrangement of a quartz crystal oscillator and a capacitor in a heat sink facing region.

FIG. 5 is a diagram showing the arrangement of the quartz crystal oscillator 300 and the capacitor 350 in the heat sink facing region 59.

Next, the arrangement of the quartz crystal oscillator 300 and the capacitor 350 in the heat sink facing region 59 will be described with reference to FIGS. 3 to 5.

Here, the arrangement of the quartz crystal oscillator 300 and the capacitor 350 in the heat sink facing region 59 will now be described. First, as described above, the quartz crystal oscillator 300 and the capacitor 350 are provided apart from the SoC 200 at the first corner portion C1 in the heat sink facing region 59. Plural capacitors 350 are provided, and all the capacitors 350 are provided in the heat sink facing region 59. Further, when the quartz crystal oscillator 300 and the capacitor 350 are provided in the vicinity of the SoC 200, noises of clock signals that the SoC 200 receives are prevented.

The quartz crystal oscillator 300 and the capacitor 350 are provided on the lower side in the vertical direction in the heat sink facing region 59. Here, an air around the heat sink 250 is heated by the heat sink 250 that receives heat from the SoC 200. As a result of this heating, an air flow (see arrow D1) directed upward between the fin plates 253 is generated. Therefore, a first low-temperature region A1, which is a lower region of the heat sink 250, becomes lower in temperature than the other portions. The quartz crystal oscillator 300 and the capacitor 350 are provided at a position facing the first low-temperature region A1.

Although not described above, the image forming apparatus 1 includes a fan 600 having a forced cooling function for cooling elements provided on the control board 100. The SoC 200 is provided in the region receiving an air flow generated by the fans 600. In the illustrated example, the SoC 200 generates the air flow from the back side toward the front side (see arrow D2) in the depth direction. Therefore, a second low-temperature region A2, which is a region on an upstream side of the air flow in the heat sink 250, that is, a region on the back side of the heat sink 250, becomes lower in temperature than the other portions. The quartz crystal oscillator 300 and the capacitor 350 are provided at a position facing the second low-temperature region A2.

As described above, the quartz crystal oscillator 300 and the capacitor 350 are provided in the first low-temperature region A1 and at a position facing the second low-temperature region A2. As a result, the quartz crystal oscillator 300 and the capacitor 350 are provided in a region where the temperature in the heat sink facing region 59 hardly rises. In addition, by utilizing a property that heat collects upward, the quartz crystal oscillator 300 and the capacitor 350 are disposed below the SoC 200, thereby reducing the effect of heat from the SoC 200. In addition, the quartz crystal oscillator 300 and the capacitor 350 are disposed at a position receiving the air flow from the fans 600, thereby reducing the thermal effect from the SoC 200.

In the illustrated example, the quartz crystal oscillator 300 is disposed in a direction in which the longitudinal direction thereof intersects the air flow (see arrow D2) from the fan 600. As a result, the quartz crystal oscillator 300 is cooled by the air flow as compared with the configuration in which the longitudinal direction is disposed along the air flow. In addition, in the illustrated example, the quartz crystal oscillator 300 and the capacitor 350 are provided upstream of the first strut 291 with respect to the air flow (see arrow D2) from the fan 600. This avoids that the air flow towards the quartz crystal oscillator 300 being obstructed by the first strut 291.

Modification Example

In the above description, the longitudinal direction of each of the quartz crystal oscillator 300 and the capacitor 350 is provided along the vertical direction, but the present invention is not limited thereto. For example, the longitudinal direction of at least one of the quartz crystal oscillator 300 and the capacitor 350 may be arranged in another direction such as a horizontal direction.

Although the above description has been made using a SoC 200, the present invention is not limited to a SoC 200 as long as it is a semiconductor integrated circuit, and for example, CPUs may be used.

The above description shows that the surface of the board main body 50 is oriented in the vertical direction, which is non-limiting. The surface of the board main body 50 may be oriented in the horizontal direction or may be inclined with respect to the vertical direction.

In the above description, the heat sink 250 for radiating the heat of the SoC 200 has been described as an example, but any member may be used as long as the member is provided in the SoC 200 and has a function of cooling the SoC 200, and for example, Peltier elements and fans may be used.

In the above description, the quartz crystal oscillator 300 for generating the clock signal has been described as an example, but other oscillators such as ceramics oscillators may be used as long as they are members for generating a clock signal transmitted to the SoC 200.

In the above description, the control board 100 provided in the image forming apparatus 1 has been described, but the above configuration may be adopted in an apparatus having a semiconductor integrated circuit other than the image forming apparatus.

The control board 100 in the above description is an example of a board. The SoC 200 is an example of a semiconductor integrated circuit. The heat sink 250 is an example of a radiator. The quartz crystal oscillator 300 is an example of an oscillator. The fin plate 253 is an example of a heat radiating portion. The fan 600 is an example of an air flow generator. The first strut 291 is an example of a limiting member.

Second Exemplary Embodiment

Image Forming Apparatus 1

In the second exemplary embodiment, the image forming apparatus has the same configuration as the image forming apparatus 1 according to the first embodiment shown in FIG. 1.

Control Board 100

Figure 6:
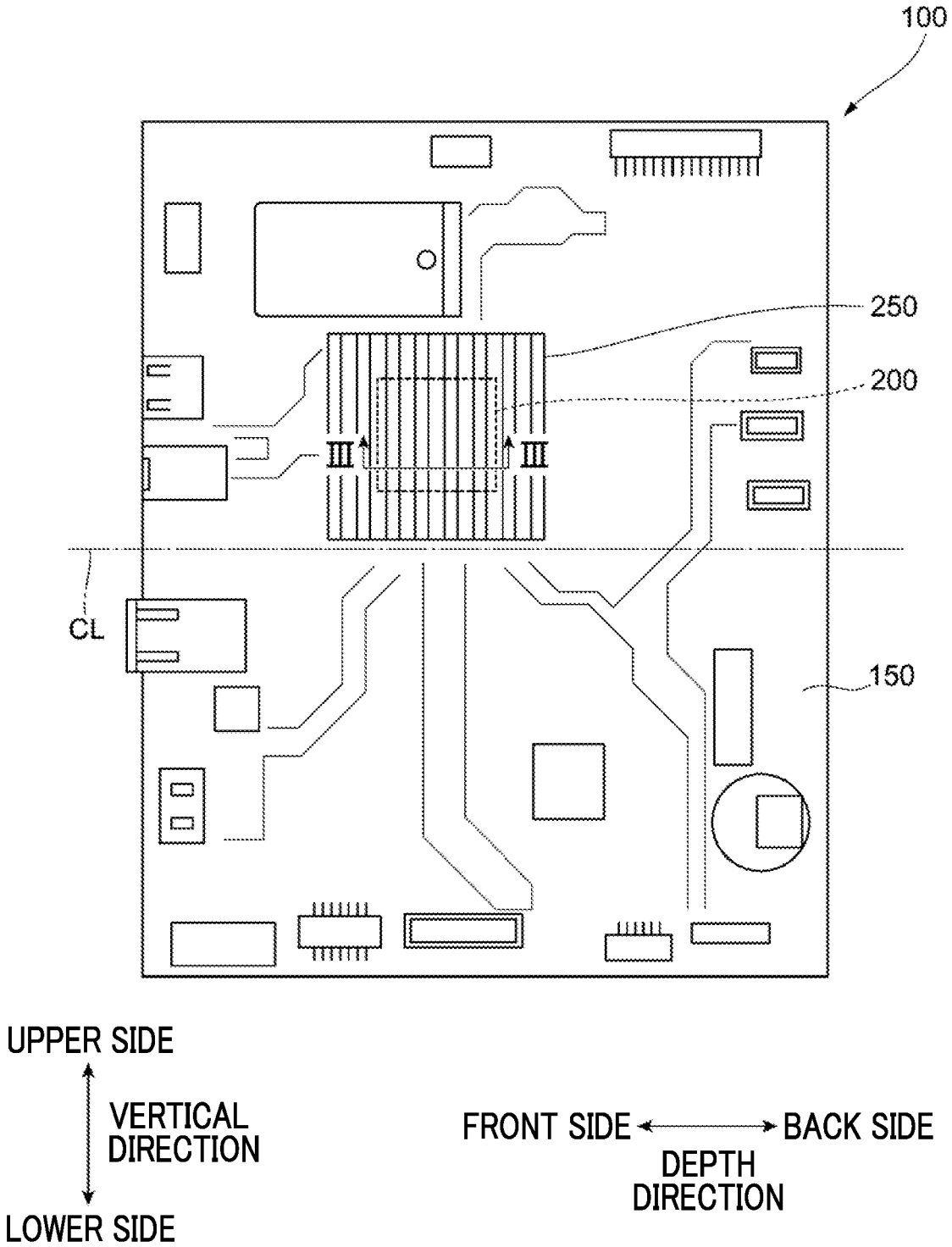
FIG. 6 is a diagram illustrating a schematic configuration of a control board.

FIG. 6 is a diagram illustrating a schematic configuration of the control board 100.

The schematic configuration of the control board 100 will be described with reference to FIG. 6.

As shown in FIG. 6, the control board 100 includes a board main body 150 which is a so-called printed circuit board formed of a glass-epoxy board or the like, a SoC (System on a Chip) 200 which is one of elements mounted on the board main body 150, and a heat sink 250 which radiates heat generated in the SoC 200. In the illustrated example, the SoC 200 is provided above a center CL in the vertical direction of the board main body 150.

Here, the SoC 200 is an exemplary semiconductor integrated circuit, and is a single semiconductor chip that performs plural functions required for the operation of the image forming apparatus 1. The illustrated SoC 200 includes plural CPUs having different operating frequencies, and plural clock generation circuits, that is, Phase Locked Loop (PLL) circuits, having different operating frequencies. Here, the SoC 200 is described as one of the elements mounted on the board main body 150, but plural elements including the SoC 200 are mounted on the board main body 150. The element mounted on the board main body 150 may include, for example, a main control element such as a hard disk, a CPU (Central Processing Unit), a memory, or a capacitor, an external connection element such as a facsimile or a Universal Serial Bus device (USB) that connects to an external device of the image forming apparatus 1, or a voltage supply element including a high voltage core power supply (for example, 1.1 V) and a low voltage core power supply (for example, 0.9 V).

Plural CPUs having different operating frequencies can be regarded as plural CPUs having different transient current fluctuations. Here, a large transient current fluctuation indicates, for example, a high operating frequency or a large scale of a semiconductor integrated circuit, and a small transient current fluctuation indicates, for example, a low operating frequency or a small scale of a semiconductor integrated circuit.

Cross Section of Control Board 100

Figure 7:
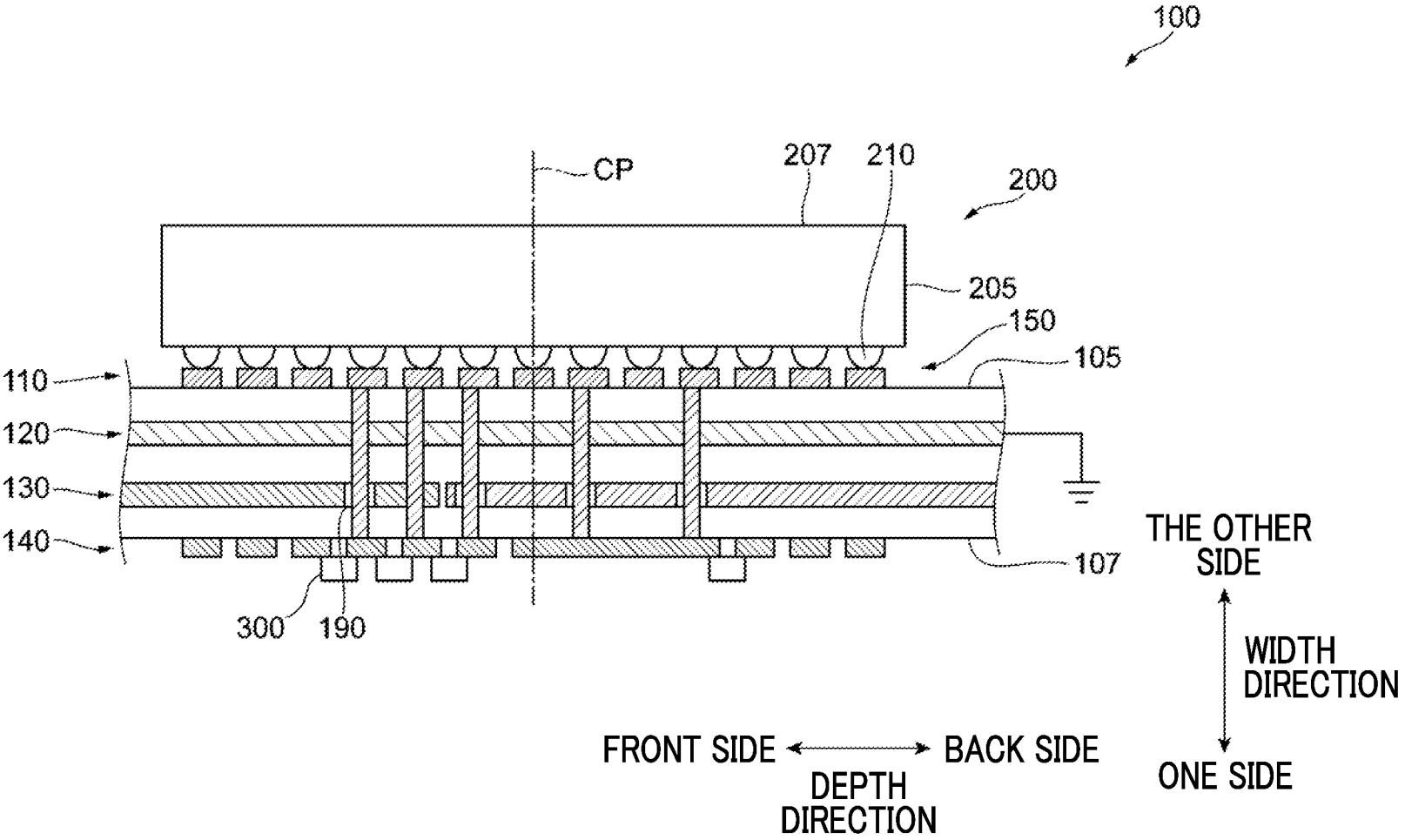
FIG. 7 is a cross-sectional view of the control board taken along a line of FIG. 6.

FIG. 7 is a cross-sectional view of the control board 100 taken along a line in FIG. 6. In FIG. 7, the description of the heat sink 250 is omitted.

Next, a detailed configuration of the control board 100 will be described with reference to FIG. 7.

As shown in FIG. 7, the board main body 150 has a first surface 105, which is a surface on which the SoC 200 is mounted, and a second surface 107, which is a surface opposite to the first surface 105 and on which the capacitor 310 is mounted. The board main body 150 is formed by stacking plural layers. More specifically, the board main body 150 is formed of four layers: a first layer 110, a second layer 120, a third layer 130, and a fourth layer 140. The first to fourth layers 110 to 140 are provided in this order in a direction from the first surface 105 toward the second surface 107. The board main body 150 has vias 190 that pass through the board main body 150 in the thickness direction and connect the first layer 110 to the fourth layer 140 to each other.

The SoC 200 includes a flat SoC board 205 having plural CPUs and the like provided therein, and a SoC terminal 210 provided on a plate surface of the SoC board 205 and electrically connected to the board main body 150. Here, a heat sink 250 (see FIG. 6) is fixed to a top surface 207 of the SoC board 205, which is a surface opposite to the SoC terminal 210.

Plural capacitors 310 are provided on the second surface 107 of the board main body 150, and are electrically connected to the fourth layer 140.

Arrangement of SoC Terminals 210

Figure 8:
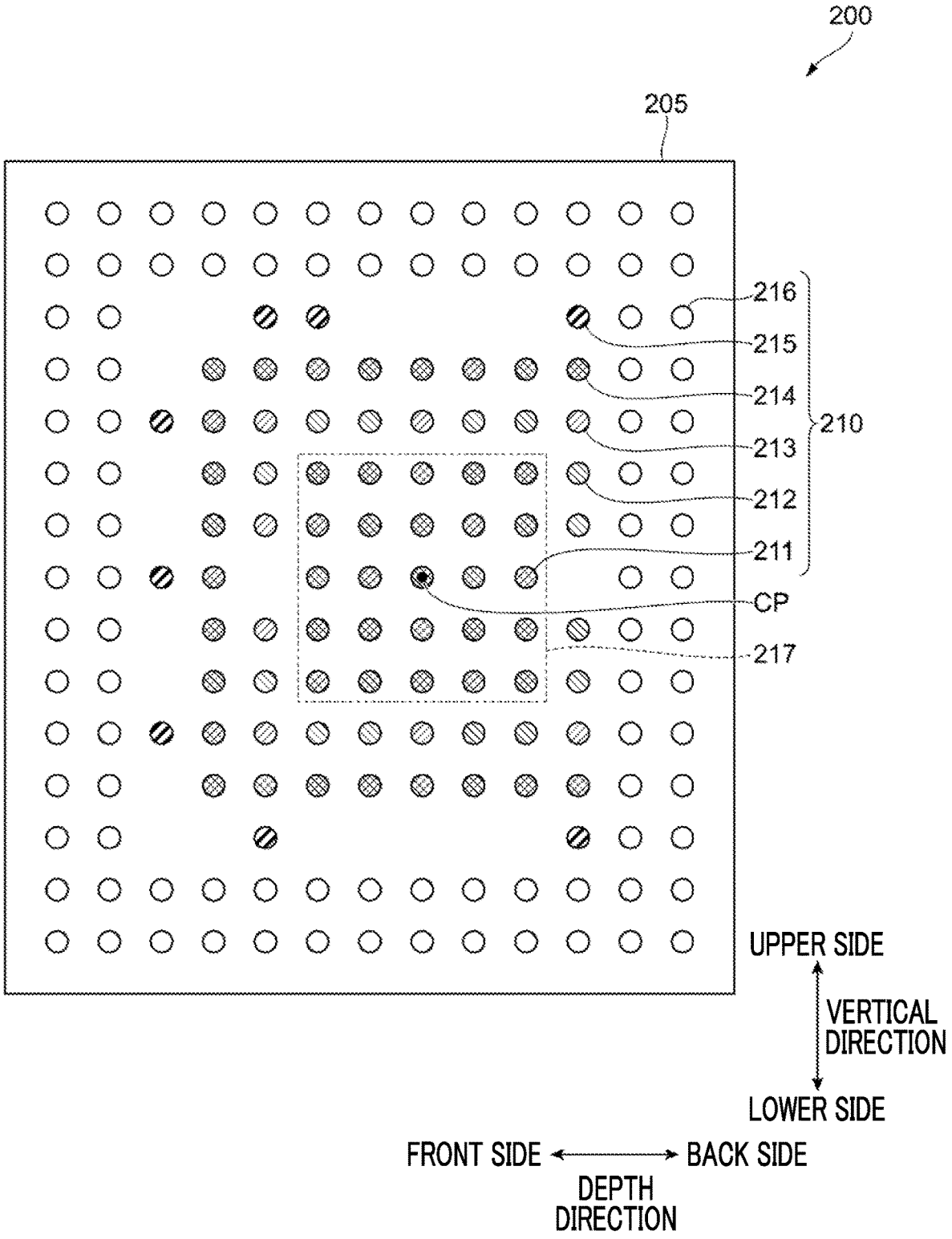
FIG. 8 is a diagram showing an arrangement of SoC terminals in a SoC board.

FIG. 8 is a diagram showing the arrangement of the SoC terminals 210 in the SoC board 205. FIG. 8 is a view of the SoC board 205 in a direction from one side to the other side in the width direction.

Next, the arrangement of the SoC terminals 210 in the SoC board 205 will be described with reference to FIG. 8. As shown in FIG. 8, the SoC terminal 210 is composed of a large number of terminals provided in a dispersed manner on the plate surface of the SoC board 205 having a substantially rectangular shape in plan view. In the following description, an imaginary line (see FIG. 7) passing through a center (for example, an intersection of a center and a diagonal line) of the plate surface of the SoC board 205 and along the width direction may be simply referred to as a center line CP. In addition, the periphery of the center line CP on the plate surface of the SoC board 205 may be referred to as a central side, and the outer peripheral side of the plate surface of the SoC board 205 may be referred to as an outside.

The SoC terminal 210 is composed of plural types of terminals. Specifically, the SoC terminal 210 includes a first ground terminal 211, a first high power supply terminal 212, a second high power supply terminal 213, a second ground terminal 214, a PLL power supply terminal 215, and a signal terminal 216. Here, the first ground terminal 211 and the second ground terminal 214 are provided to be grounded. As described above, the first high power supply terminal 212 and the second high power supply terminal 213 are provided in the SoC board 205 as described above and supply power supply voltages to each of the CPUs having different operating frequencies. In the illustrated example, a frequency of the power supply voltage supplied via the first high power supply terminal 212 is larger than a frequency of the power supply voltage supplied via the second high power supply terminal 213. The PLL power supply terminal 215 supplies a power supply voltage to a PLL circuit provided in the SoC board 205. In the illustrated example, the current flowing via the PLL power supply terminal 215 is smaller than the current flowing via the first high power supply terminal 212 and the second high power supply terminal 213.

Next, the positional relationship of each SoC terminal 210 on the plate surface of the SoC board 205 will be described. First, the first ground terminal 211 is provided on the central side of the SoC board 205. To explain further, the first ground terminal 211 is provided in a substantially rectangular region 217 on the central side of the SoC board 205.

The first high power supply terminal 212 and the second high power supply terminal 213 are provided on the outside of the SoC board 205 with respect to the first ground terminal 211. The first high power supply terminal 212 and the second high power supply terminal 213 are provided along an outer periphery of the region 217. Here, the illustrated second high power supply terminal 213 is disposed between the first high power supply terminals 212 provided side by side along the outer periphery of the region 217.

The second ground terminal 214, the PLL power supply terminal 215, and the signal terminal 216 are provided on the outside of the SoC board 205 with respect to the first high power supply terminal 212 and the second high power supply terminal 213. To further explain, the second ground terminal 214, the PLL power supply terminal 215, and the signal terminal 216 are arranged in this order in a direction from the central side toward the outside of the SoC board 205. The signal terminals 216 shown in the figure are provided along the respective sides of the plate surface of the SoC board 205. To explain further, the signal terminal 216 is arranged to surround an outer periphery of the PLL power supply terminal 215.

Board Main Body 150

Figure 9A:
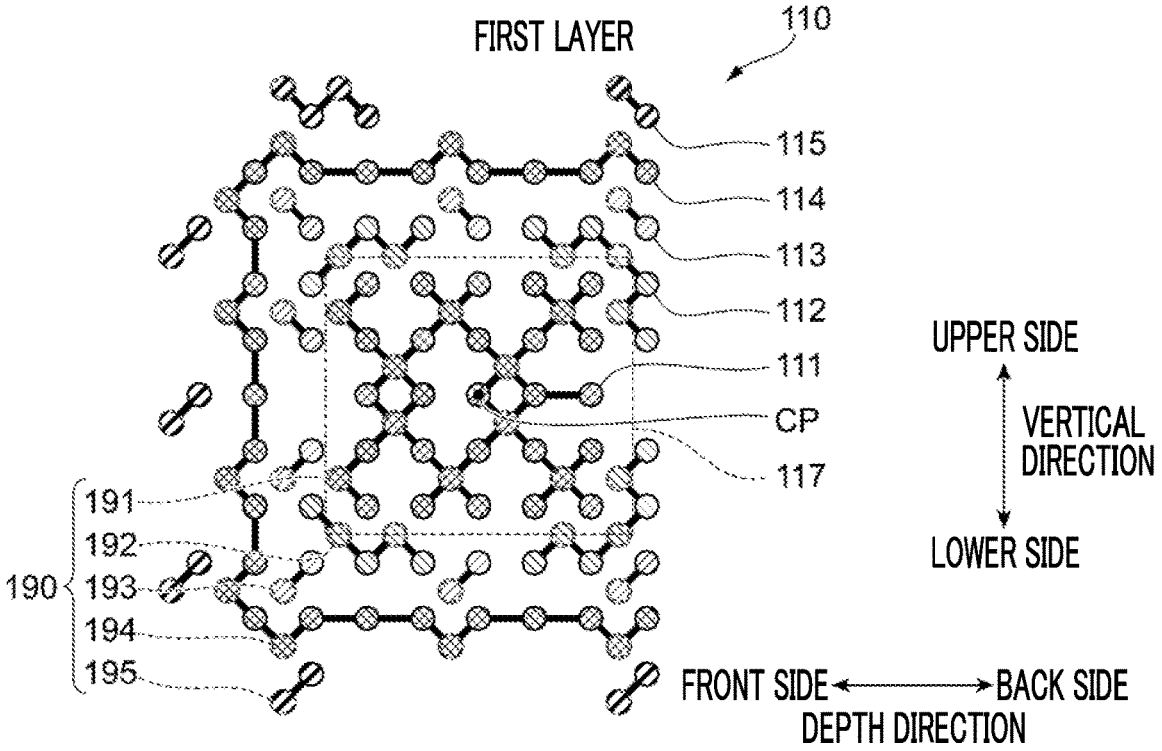
FIG. 9A is a diagram illustrating a first layer.
Figure 9B:
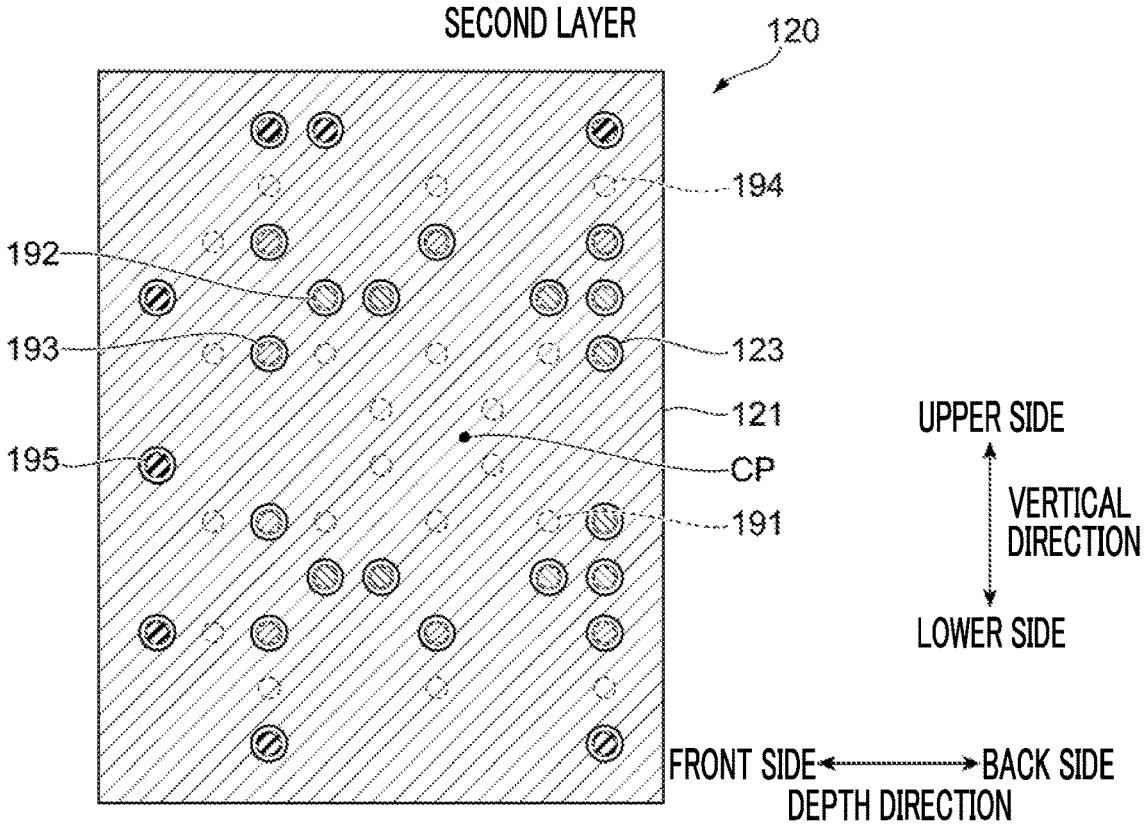
FIG. 9B is a diagram illustrating a second layer.

FIG. 9A is a diagram illustrating the first layer 110, and FIG. 9B is a diagram illustrating the second layer 120.

Figure 10A:
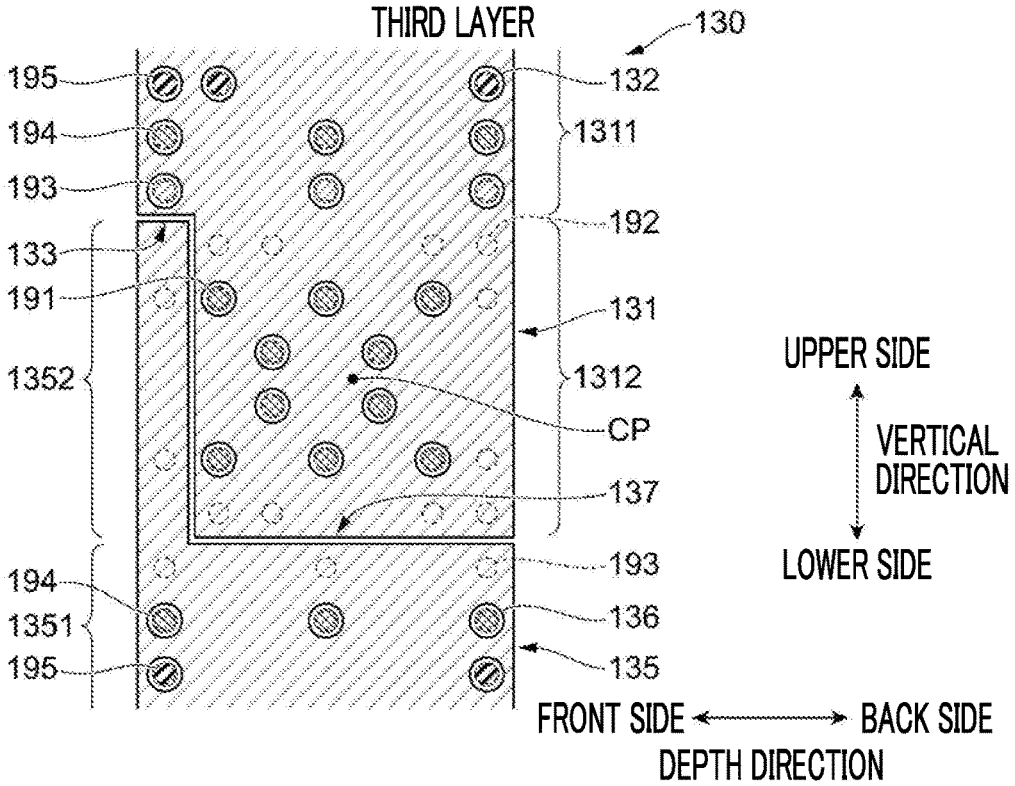
FIG. 10A is a diagram illustrating a third layer.
Figure 10B:
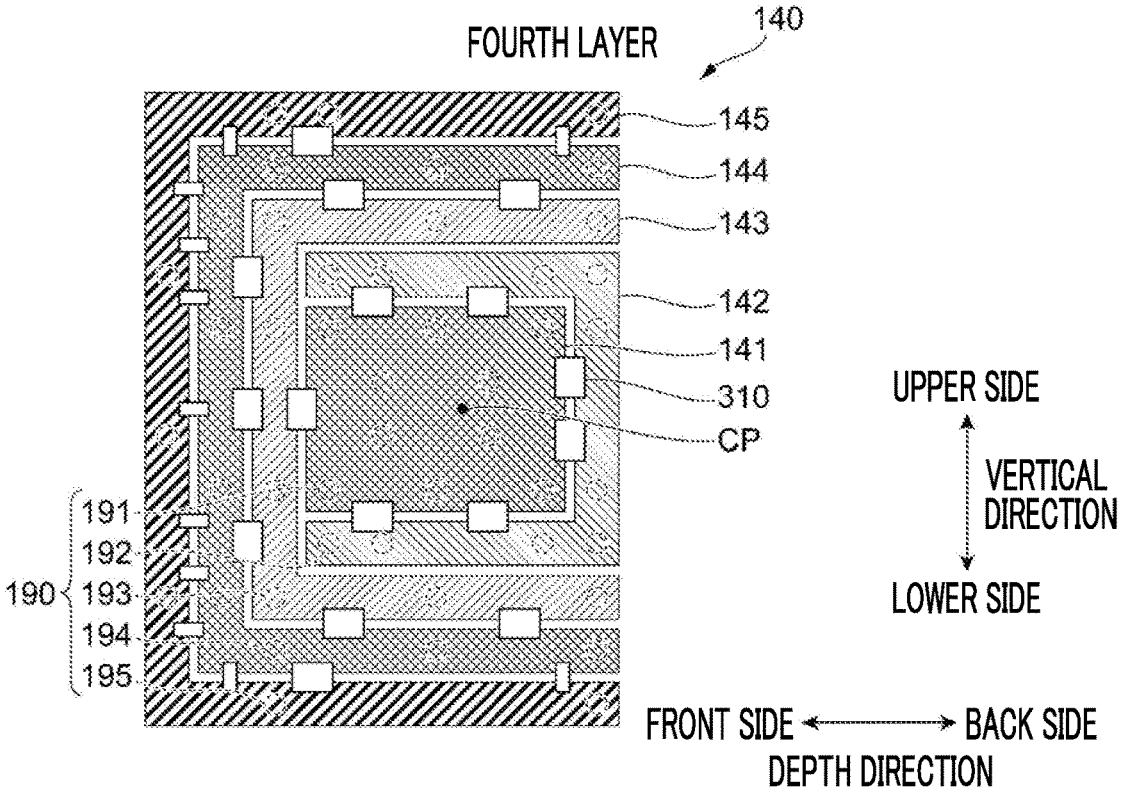
FIG. 10B is a diagram illustrating a fourth layer.

FIG. 10A is a diagram illustrating the third layer 130, and FIG. 10B is a diagram illustrating the fourth layer 140.

In FIGS. 9A to 10B, the pattern connected to the signal terminal 216 is not shown. FIGS. 9A to 10B are structural diagrams of the respective layers when the SoC board 205 is viewed in a direction from the other side in the width direction toward one side.

Next, the configurations of the first layer 110, the second layer 120, the third layer 130, and the fourth layer 140 included in the board main body 150 will be described in order with reference to FIGS. 8 to 10B. In the following description, a pattern (not shown) connected to the signal terminal 216 is omitted. In the following description, the periphery of the center line CP in each layer may be referred to simply as the central side, and the side separated from the center line CP may be referred to simply as the outside.

First Layer 110

As shown in FIG. 9A, the first layer 110 is formed of plural types of patterns. Specifically, the first layer 110 includes a first ground pattern 111, a first high power supply pattern 112, a second high power supply pattern 113, a second ground pattern 114, and a PLL power supply pattern 115. The first ground pattern 111, the first high power supply pattern 112, the second high power supply pattern 113, the second ground pattern 114, and the PLL power supply pattern 115 are electrically connected to the SoC terminals 210 in the SoC 200, that is, the first ground terminal 211, the first high power supply terminal 212, the second high power supply terminal 213, the second ground terminal 214, and the PLL power supply terminal 215.

The first ground pattern 111, the first high power supply pattern 112, the second high power supply pattern 113, the second ground pattern 114, and the PLL power supply pattern 115 are electrically connected to the via 190. In the following description, each of the vias 190 connected to the first ground pattern 111, the first high power supply pattern 112, the second high power supply pattern 113, the second ground pattern 114, and the PLL power supply pattern 115 may be referred to as a first via 191, a second via 192, a third via 193, a fourth via 194, and a fifth via 195.

Hereinafter, the positional relationship among the first ground pattern 111, the first high power supply pattern 112, the second high power supply pattern 113, the second ground pattern 114, and the PLL power supply pattern 115 will be described.

First, the first ground pattern 111 is provided on the central side of the first layer 110. To explain further, the first ground terminal 211 is provided in the substantially rectangular region 117 on the central side of the first layer 110. The first high power supply pattern 112, the second high power supply pattern 113, the second ground pattern 114, and the PLL power supply pattern 115 are arranged in this order in a direction from the central side toward the outside of the first layer 110.

Here, the first layer 110 is provided at a position facing each of the SoC terminals 210 in the SoC 200 described above. For example, the illustrated first ground pattern 111 is provided at a position facing the first ground terminal 211 of the SoC terminal 210. The first ground pattern 111 is formed of plural terminals, and the terminals are connected to each other by a wiring pattern. To further explain, the terminals of the first ground pattern 111 in FIG. 9A are illustrated by a circle with a thick line and a circle with a thin line. Here, the thick-line circle indicates a terminal facing the first ground terminal 211 in a SoC 200 mounted on the board main body 150. On the other hand, the thin-line circle indicates a terminal facing the first via 191 passing through the board main body 150.

The first high power supply pattern 112 faces the first high power supply terminal 212 of the SoC terminal 210. The second high power supply pattern 113 faces the second high power supply terminal 213 of the SoC terminal 210. The second ground pattern 114 faces the second ground terminal 214 of the SoC terminal 210. The PLL power supply pattern 115 faces the PLL power supply terminal 215 of the SoC terminal 210. Though detailed description is omitted, in each of the terminals of the first high power supply pattern 112, the second high power supply pattern 113, the second ground pattern 114, and the PLL power supply pattern 115 shown in the drawing, a terminal facing the terminal of the SoC terminal 210 is indicated by a thick-line circle, and a terminal facing the via 190 (the second via 192 to the fifth via 195) is indicated by a thin-line circle.

A region where the first layer 110 is provided is a region covered with the SoC 200, that is, a region facing the SoC 200. Here, the region where the first layer 110 is provided may be larger or smaller than the region covered with the SoC 200. In addition, the second layer 120, the third layer 130, and the fourth layer 140 may be provided at positions corresponding to the regions covered by the SoC 200, or may be larger or smaller than the regions covered by the SoC 200.

Second Layer 120

As shown in FIG. 9B, the second layer 120 is formed of a ground layer 121 which is formed in a flat plate shape and provided to be grounded. The ground layer 121 is electrically connected to the first ground pattern 111 and the second ground pattern 114 of the first layer 110 via the first via 191 and the fourth via 194. The ground layer 121 has plural through-holes 123. The through-hole 123 is passed through by the second via 192, the third via 193, and the fifth via 195. The second via 192, the third via 193, and the fifth via 195 passing through the through-hole 123 are not electrically connected to the ground layer 121.

Third Layer 130

As shown in FIG. 10A, the third layer 130 is formed of a layer formed in a flat plate shape. The third layer 130 has a first high power supply layer 131 and a second high power supply layer 135. Here, the first high power supply layer 131 is electrically connected to the first high power supply pattern 112 of the first layer 110 via the second via 192. The first high power supply layer 131 has plural through-holes 132. The first via 191, the third via 193, the fourth via 194, and the fifth via 195 pass through the through-holes 132. The first via 191, the third via 193, the fourth via 194, and the fifth via 195 passing through the through-holes 132 are not electrically connected to the first high power supply layer 131.

The second high power supply layer 135 is electrically connected to the second high power supply pattern 113 of the first layer 110 via the third via 193. The second high power supply layer 135 has plural through-holes 136. The fourth via 194 and the fifth via 195 pass through the through-holes 136. The fourth via 194 and the fifth via 195 passing though the through-holes 132 are not electrically connected to the second high power supply layer 135.

The first high power supply layer 131 and the second high power supply layer 135 are substantially rectangular in plan view. The first high power supply layer 131 and the second high power supply layer 135 are provided in a direction in which each of longitudinal directions is oriented along the vertical direction, and are arranged side by side in the vertical direction. In a region where the first high power supply layer 131 and the second high power supply layer 135 face each other, the first high power supply layer 131 and the second high power supply layer 135 have a notch 133 and a notch 137, respectively. In the region where the first high power supply layer 131 and the second high power supply layer 135 face each other, an end of each of the high power supply layers is disposed in each of the notches 133 and 137 in a corresponding manner. In other words, the first high power supply layer 131 and the second high power supply layer 135 have a nested configuration.

Hereinafter, the configurations of the first high power supply layer 131 and the second high power supply layer 135 will be described in detail.

First, the first high power supply layer 131 includes a wide portion 1311 having a wide width in the depth direction, and a narrow portion 1312 positioned on the lower side in the vertical direction of the wide portion 1311 and having a width narrower than the wide portion 1311. The narrow portion 1312 of the first high power supply layer 131 has a shape accommodated in the notch 137 of the second high power supply layer 135. For example, the dimension (for example, length or width) of the narrow portion 1312 of the illustrated first high power supply layer 131 corresponds to the dimension of the notch 137 of the second high power supply layer 135.

The second high power supply layer 135 includes a wide portion 1351 having a wide width in the depth direction, and a narrow portion 1352 positioned on the upper side in the vertical direction of the wide portion 1351 and having a width narrower than the wide portion 1351. The narrow portion 1352 of the second high power supply layer 135 has a shape accommodated in the notch 133 of the first high power supply layer 131. For example, the dimension (for example, length or width) of the narrow portion 1352 of the illustrated second high power supply layer 135 corresponds to the dimension of the notch 133 of the first high power supply layer 131.

Here, the width of the narrow portion 1312 of the first high power supply layer 131 is wider in the depth direction than the width of the narrow portion 1352 of the second high power supply layer 135. That is, in the region where the first high power supply layer 131 and the second high power supply layer 135 face each other, a region connected to the second via 192 of the first high power supply layer 131 is larger than a region connected to the third via 193 of the second high power supply layer 135. As a result, the power supply voltage supplied via the first high power supply layer 131 is stabilized.

Fourth Layer 140

As shown in FIG. 10B, the fourth layer 140 is formed of plural types of patterns. Specifically, the fourth layer 140 includes a first ground pattern 141, a first high power supply pattern 142, a second high power supply pattern 143, a second ground pattern 144, and a PLL power supply pattern 145. The first ground pattern 141 and the second ground pattern 144 are electrically connected to the ground layer 121 of the second layer 120 via the first via 191 and the fourth via 194. The first high power supply pattern 142 is electrically connected to the first high power supply layer 131 of the third layer 130 via the second via 192. The second high power supply pattern 143 is electrically connected to the second high power supply layer 135 of the third layer 130 via the third via 193. The PLL power supply pattern 145 is electrically connected to the PLL power supply pattern 115 of the first layer 110 via the fifth via 195.

Hereinafter, configurations of the first ground pattern 141, the first high power supply pattern 142, the second high power supply pattern 143, the second ground pattern 144, and the PLL power supply pattern 145 will be described in detail.

First, the first ground pattern 141 is formed in a substantially rectangular shape in plan view on the central side of the fourth layer 140. On the other hand, the first high power supply pattern 142, the second high power supply pattern 143, the second ground pattern 144, and the PLL power supply pattern 145 are formed outside the first ground pattern 141 in a substantially U-shape, in other words, in a C-shape. Each of the first high power supply pattern 142, the second high power supply pattern 143, the second ground pattern 144, and the PLL power supply pattern 145 is formed in a strip shape, and can be regarded as a configuration bent at plural points in a longitudinal direction.

There is a difference in an arrangement direction between the first high power supply pattern 142, and the second high power supply pattern 143, the second ground pattern 144 and the PLL power supply pattern 145. Specifically, the first high power supply pattern 142 is provided so as to open the front side in the depth direction, while the second high power supply pattern 143, the second ground pattern 144, and the PLL power supply pattern 145 are provided so as to open the back side in the depth direction.

Here, the first high power supply pattern 142 is formed along an outer periphery of the first ground pattern 141. The first high power supply pattern 142 in the illustrated example is provided so as to open one side of the first ground pattern 141 and face the other three sides of the outer periphery of the first ground pattern 141. With this configuration, an area of a region where the first ground pattern 141 and the first high power supply pattern 142 face each other increases, and a capacitance between the first high power supply pattern 142 and the first ground pattern 141 increases. Plural capacitors 310 are provided between the first ground pattern 141 and the first high power supply pattern 142.

The second high power supply pattern 143 is formed along an outer periphery of the first high power supply pattern 142. The second high power supply pattern 143 in the illustrated example has a portion facing one side of the first ground pattern 141 that is not covered by the first high power supply pattern 142. The capacitor 310 is provided between the second high power supply pattern 143 and the first ground pattern 141. On the other hand, the capacitor 310 is not provided between the second high power supply pattern 143 and the first high power supply pattern 142.

The second ground pattern 144 is formed along the outer periphery of the second high power supply pattern 143. The second ground pattern 144 in the illustrated example is formed in a substantially U-shape in the same direction as the second high power supply pattern 143. This increases an area where the second ground pattern 144 and the second high power supply pattern 143 face each other. The capacitors 310 are provided between the second ground pattern 144 and the second high power supply pattern 143.

The PLL power supply pattern 145 is formed along an outer periphery of the second ground pattern 144. The PLL power supply pattern 145 in the illustrated example is formed in a substantially U-shape in the same direction as the second ground pattern 144. This increases an area where the PLL power supply pattern 145 and the second ground pattern 144 face each other. The capacitors 310 are provided between the PLL power supply pattern 145 and the second ground pattern 144.

In the above description, it has been described that the board main body 150 has a four-layer structure. Here, as an aspect differing from the present exemplary embodiment, a six-layer configuration may be employed in a board (not shown) on which a SoC 200 is mounted. This is, for example, to widen the line width (area) of the terminal and to secure a wiring area for providing a large number of capacitors 310. On the other hand, as the number of layers of the board increases, the manufacturing cost of the board is increased. Therefore, if a wiring is performed as in the illustrated board main body 150, a wiring can be performed even in a four-layer board having a relatively small wiring area. In addition, in the illustrated board main body 150, the number of layers in the board is reduced while maintaining the power supply quality as compared with, for example, a six-layer board (not shown).

Connection Relationship by Via 190

As described above, the first layer 110 to the fourth layer 140 are connected to each other by the via 190, that is, the first via 191 to the fifth via 195. Here, a connection relationship by each of the first via 191 to the fifth via 195 will be described.

First, the first via 191 electrically connects the first ground pattern 111 of the first layer 110, the ground layer 121 of the second layer 120, and the first ground pattern 141 of the fourth layer 140 to each other. The first via 191 is provided to be grounded.

The second via 192 electrically connects the first high power supply pattern 112 of the first layer 110, the first high power supply layer 131 of the third layer 130, and the first high power supply pattern 142 of the fourth layer 140 to each other.

The third via 193 electrically connects the second high power supply pattern 113 of the first layer 110, the second high power supply layer 135 of the third layer 130, and the second high power supply pattern 143 of the fourth layer 140 to each other.

The fourth via 194 electrically connects the second ground pattern 114 of the first layer 110, the ground layer 121 of the second layer 120, and the second ground pattern 144 of the fourth layer 140 to each other. The fourth via 194 is provided to be grounded.

The fifth via 195 electrically connects the PLL power supply pattern 115 of the first layer 110 and the PLL power supply pattern 145 of the fourth layer 140 to each other.

Here, as described above, the first high power supply pattern 142 to the PLL power supply pattern 145 have a configuration having a longer length with respect to a width, that is, have a so-called elongated pattern shape. Vias 190 are provided at plural positions of the elongated pattern in a longitudinal direction. That is, the vias 190 are connected in parallel to the SoC 200. This keeps the apparent inductance of the via 190 low.

Connection Relationship in Fourth Layer 140

Next, the connection relationship of each pattern in the fourth layer 140 will be described.

First, as described above, the first ground pattern 141 of the fourth layer 140 is formed in a substantially rectangular shape in plan view on the central side of the fourth layer 140. The first ground pattern 141 is connected to plural first vias 191. The first ground pattern 141 configured as described above has an area larger than that of the first high power supply pattern 142, the second high power supply pattern 143, and the PLL power supply pattern 145, and has a stable potential.

Of the first high power supply pattern 142, the second high power supply pattern 143, and the PLL power supply pattern 145, the first high power supply pattern 142 having the highest operating frequency is provided on the outer periphery of the first ground pattern 141, that is, on the most central side. As described above, by arranging the first high power supply pattern 142 on the central side, an interval between the first high power supply pattern 142 and the first ground pattern 141 is reduced. As described above, when the interval between the first high power supply pattern 142 and the first ground pattern 141 is reduced, the parasitic capacitance increases, and an effect equivalent to, for example, disposing the capacitor 310 is obtained. Therefore, noise of the power supplied via the first high power supply pattern 142 is prevented.

In the illustrated example, the capacitor 310 is disposed between the first high power supply pattern 142 and the first ground pattern 141 in order to further increase the parasitic capacitance. By arranging the first high power supply pattern 142 on the central side as described above, the number of the capacitors 310 to be provided is reduced. In addition, the capacitor 310 provided between the first high power supply pattern 142 and the first ground pattern 141 in the illustrated example has a substantially rectangular parallelepiped shape, and a portion along a longitudinal direction (long side) is an electrode. The capacitor 310 is provided along the outer periphery of the first high power supply pattern 142 and the first ground pattern 141. This reduces the distance between the first high power supply pattern 142 and the first ground pattern 141. In addition, in the illustrated example, the capacitor 310 of the long-side electrode whose long side is the electrode is used as the means for reducing the distance between the capacitor electrodes, but a capacitor having another configuration such as a small short-side electrode capacitor (not shown) may be used.

In the illustrated example, the first high power supply pattern 142 is provided so as to surround the first ground pattern 141. With this configuration, the first high power supply pattern 142 runs in parallel with the first ground pattern 141. Since the pattern area in which the first high power supply pattern 142 runs in parallel with the first ground pattern 141 increases, the parasitic capacitance increases, and as a result, the power supply noise is easily absorbed.

In the illustrated example, the second high power supply pattern 143 is provided so as to surround the first ground pattern 141 and the first high power supply pattern 142. The second high power supply pattern 143 is smaller than the first high power supply pattern 142, but has a portion that runs in parallel with the first ground pattern 141. In this manner, the second high power supply pattern 143 is wired along the first ground pattern 141 on the central side, which is stable, so that the power supply noise is easily absorbed.

In the illustrated example, the second ground pattern 144 is wired so as to surround the first high power supply pattern 142 and the second high power supply pattern 143. Then, the PLL power supply pattern 145 is wired so as to surround the second ground pattern 144. This is a configuration in which the first high power supply pattern 142 and the second high power supply pattern 143 are wired, so that the second ground pattern 144 is wired instead of the configuration in which the PLL power supply pattern 145 is aligned with the first ground pattern 141. The PLL power supply pattern 145 has a portion that runs in parallel with the second ground pattern 144. In this manner, by wiring the PLL power supply pattern 145 along the second ground pattern 144 on the central side, which is stable, noise of the PLL power supply is easily absorbed.

Here, the PLL circuits of the SoC 200 are generally less resistant to noises. To explain further, the PLL power supply pattern 145 does not require a large parasitic capacitance because it consumes less current than the first high power supply pattern 142 and the second high power supply pattern 143, but the PLL lock may be disengaged when, for example, noise occurs in the power supply. Therefore, by providing the second ground pattern 144, an influence of noise received from the first high power supply pattern 142 and the second high power supply pattern 143 is reduced.

PLL Power Supply Circuit Configuration

Figure 11:
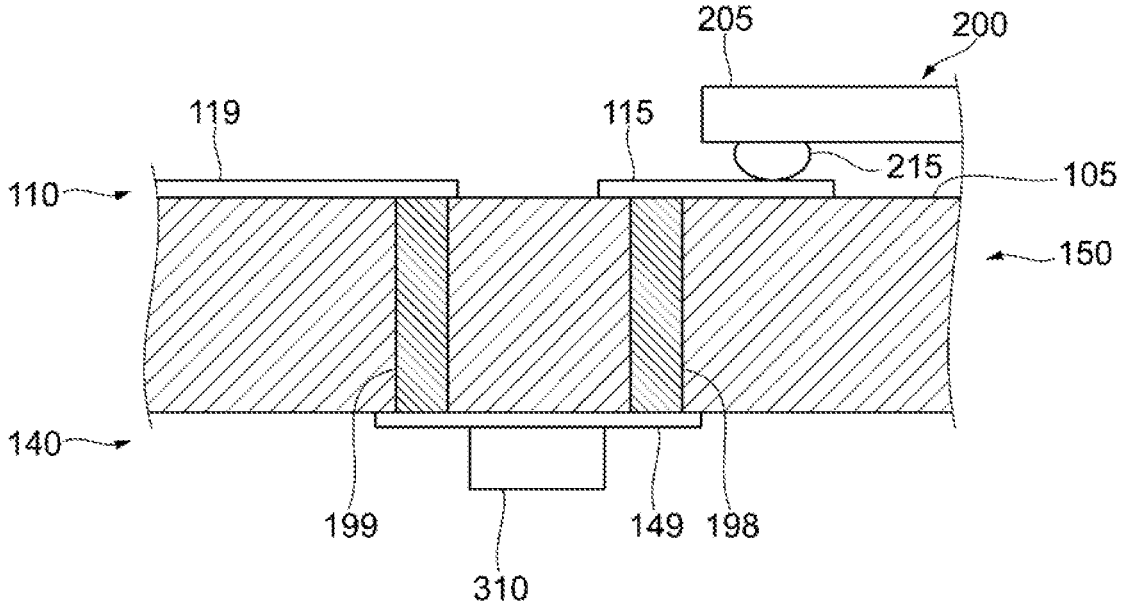
FIG. 11 is a diagram illustrating a circuit configuration for supplying a PLL power supply.

FIG. 11 is a diagram illustrating a circuit configuration for supplying a PLL power supply.

Next, a circuit configuration for supplying a PLL power supply will be described with reference to FIG. 11.

First, as described above, the PLL circuits of the SoC 200 have poor resistance to noises. Therefore, generally, a capacitor (not shown) is arranged in front of the respective power supply pins of the SoC 200, and a noise countermeasure component (not shown) such as a ferrite bead is added in front of the capacitor, and a PLL power supply pattern (not shown) is individually patterned to improve noise resistance. Here, as in the above SoC 200, when there are plural PLLs, mounting of noise countermeasure components such as ferrite beads and individual patterning require a larger wiring area of a board (not shown).

Therefore, in the present exemplary embodiment, by adopting the following configuration, even in a SoC 200 having plural PLL circuits, the mounting of the noise countermeasure components as described above is avoided while maintaining the noise removal capability required for the PLL power supply. That is, the noise resistance of the PLL power supply is increased in a small space.

Hereinafter, a circuit configuration for supplying a PLL power supply will be described in detail with reference to FIG. 11.

First, although not described above, the first layer 110 of the board main body 150 is provided apart from the PLL power supply pattern 115, and has another PLL power supply pattern 119 for supplying a power supply voltage to a PLL circuit provided in the SoC board 205 together with the PLL power supply pattern 115.

In addition, the fourth layer 140 of the board main body 150 has another PLL power supply pattern 149 provided apart from the PLL power supply pattern 145 (see FIG. 10B) and electrically connected to the PLL power supply pattern 115 and the other PLL power supply pattern 119. Although the other PLL power supply pattern 149 is described as a wiring pattern different from the PLL power supply pattern 145, the PLL power supply pattern 145 may be used as the other PLL power supply pattern 149.

The board main body 150 has a first PLL via 198 for electrically connecting the PLL power supply pattern 115 and the other PLL power supply pattern 149, and a second PLL via 199 for electrically connecting the other PLL power supply pattern 119 and the other PLL power supply pattern 149. In addition, the PLL power supply is supplied to the SoC 200 via the other PLL power supply pattern 119, the second PLL via 199, the other PLL power supply pattern 149, the first PLL via 198, and the PLL power supply pattern 115.

In addition, on the second surface 107 of the board main body 150, a capacitor 310 is provided in which one terminal electrode is connected to the PLL power supply pattern 145 and the other terminal electrode is provided to be grounded.

Here, the PLL power supply pattern 115 and the other PLL power supply pattern 119 are connected to the capacitor 310 via a wiring having an inductance component. Specifically, the PLL power supply pattern 115 and the capacitor 310 are electrically connected by the first PLL via 198. The other PLL power supply pattern 119 and the capacitor 310 are electrically connected by the second PLL via 199.

Here, the first PLL via 198 and the second PLL via 199 can be regarded as thinner wiring patterns than the PLL power supply pattern 115 and the other PLL power supply patterns 119. The first PLL via 198 and the second PLL via 199 have an inductance component of, for example, about 1 nH. The inductance components of the first PLL via 198 and the second PLL via 199 act as a noise removal filter. To explain further, the first PLL via 198 and the second PLL via 199 function as noise removal filters of the PLL power supply supplied to the SoC 200 via the other PLL power supply pattern 119, the other PLL power supply pattern 149, and the PLL power supply pattern 115.

In addition, in the illustrated example, the power supply wiring pattern, that is, the other PLL power supply pattern 119, the other PLL power supply pattern 149, and the PLL power supply pattern 115 themselves are a so-called low impedance wiring so as not to be affected by noise. A capacitor 310, a first PLL via 198, and a second PLL via 199 having a function of removing noise are provided between the other PLL power supply pattern 119, the other PLL power supply pattern 149, and the PLL power supply pattern 115.

As shown in the drawing, when the SoC terminal 210 is a BGA (Ball Grid Array) type, the capacitor 310, which is a noise removal capacitor, and the PLL power supply terminal 215 of the SoC 200 are connected to each other via the first PLL via 198 and the second PLL via 199. On the other hand, when the capacitor and the PLL power supply terminal can be connected to each other on the same surface on which the SoC 200 is mounted, as in a QFP (Quad Flat Package), a configuration as a noise removal filter of the PLL power supply may be provided on the same surface on which the SoC 200 is mounted.

Another PLL Power Supply Circuit Configuration

Figure 12:
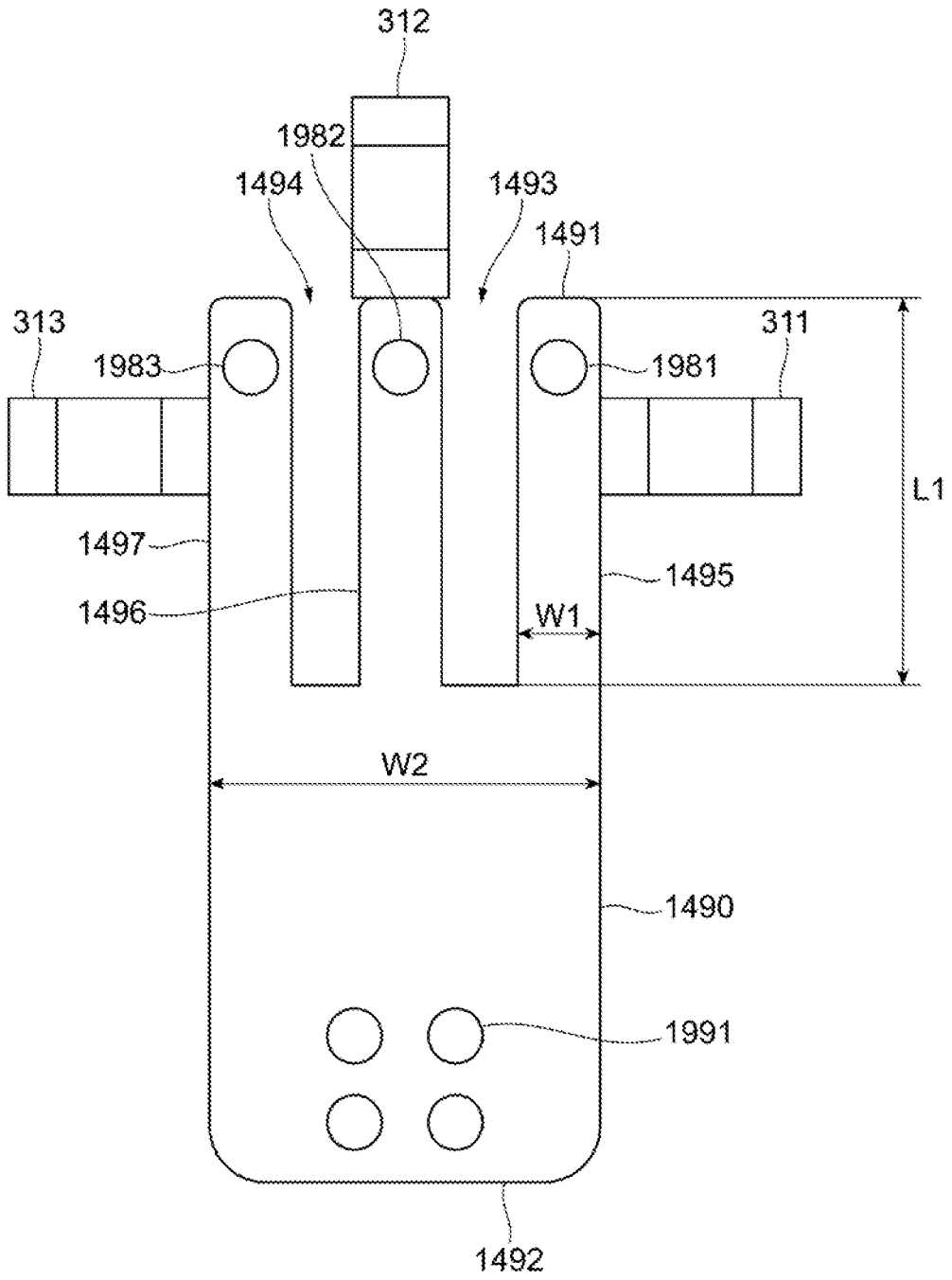
FIG. 12 is a diagram illustrating another circuit configuration for supplying a PLL power supply.

FIG. 12 is a diagram illustrating another circuit configuration for supplying a PLL power supply.

Next, another circuit configuration for supplying a PLL power supply will be described with reference to FIG. 12.

Unlike the configuration described above with reference to FIG. 11, the PLL power supply terminals 215 having different operating frequencies in the SoC 200 are close to each other, and the noise removal vias, that is, the first PLL via 198 and the second PLL via 199 cannot be individually arranged.

Therefore, as a circuit configuration for supplying a PLL power supply as shown in FIG. 12, another PLL power supply pattern 1490 provided in the fourth layer 140 of the board main body 150 may be used. The other PLL power supply pattern 1490 is substantially rectangular in plan view, and has a first slit 1493 and a second slit 1494 on one end 1491 side (upper side in the drawing) in a longitudinal direction. The first slit 1493 and the second slit 1494 are groove portions extending from one end 1491 to the other end 1492 of the other PLL power supply pattern 1490.

By forming the first slit 1493 and the second slit 1494, the one end 1491 side of the other PLL power supply pattern 1490 is branched into a first narrow portion 1495, a second narrow portion 1496, and a third narrow portion 1497. As it were, the other PLL power supply pattern 1490 has a fork shape. Here, the width (see the width W1 in the drawing) of each of the first narrow portion 1495 to the third narrow portion 1497 is narrower than the width (see the width W2 in the drawing) of the other PLL power supply pattern 1490 on the side of the other end 1492. Here, the width of each of the first narrow portion 1495 to the third narrow portion 1497 is, for example, 0.5 mm or less. The length of each of the first narrow portion 1495 to the third narrow portion 1497 (see L1 in the drawing) is, for example, 0.5 mm or more.

The first narrow portion 1495, the second narrow portion 1496, and the third narrow portion 1497 are provided with a first capacitor 311, a second capacitor 312, and a third capacitor 313 having a function of removing noise. Here, in the first capacitor 311, one terminal electrode is connected to the first narrow portion 1495, and the other terminal electrode is provided to be grounded. Similarly, in the second capacitor 312, one terminal electrode is connected to the second narrow portion 1496, and the other terminal electrode is provided to be grounded. In the third capacitor 313, one terminal electrode is connected to the third narrow portion 1497, and the other terminal electrode is provided to be grounded.

Further, each of the first narrow portion 1495, the second narrow portion 1496, and the third narrow portion 1497 is provided with a first narrow portion via 1981, a second narrow portion via 1982, and a third narrow portion via 1983. The other end 1492 of the other PLL power supply pattern 1490 is provided with plural wide portion vias 1991.

According to the above configuration, the first capacitor 311 to the third capacitor 313 are connected to the PLL power supply pattern 115 via the other PLL power supply pattern 1490. In the other PLL power supply pattern 1490, the first narrow portion 1495 to the third narrow portion 1497, which are narrower than the side of the other end 1492 as described above, are connected to the first capacitor 311 to the third capacitor 313, thereby utilizing the fact that each of the first narrow portion 1495 to the third narrow portion 1497 has an inductance component. In the illustrated example, when the PLL power supply terminals 215 having different operating frequencies are close to each other, since there are plural PLL power supply terminals 215, there are plural wiring patterns having narrow widths (the first narrow portion 1495 to the third narrow portion 1497), and the other PLL power supply pattern 1490 has a fork shape.

In the case where the PLL power supply terminals 215 are not close to each other, the fork shape is not necessarily obtained when the wiring pattern having the above-mentioned narrow width is used. For example, plural thin wiring patterns may be arranged in different directions.

The configuration shown in FIGS. 11 and 12 can be regarded as a wiring board as follows. That is, it can be regarded as a wiring board which includes a board main body on which a semiconductor integrated circuit having plural elements and plural clock generation circuits for supplying clock signals of mutually different operating frequencies to the respective elements is mounted, a power supply wiring that is provided in the board main body to supply power to one of the clock generation circuits, a capacitor that is connected to the power supply wiring to prevent noise of power supply supplied via the power supply wiring, and a connection line that connects the power supply wiring and the capacitor and has a line width narrower than that of the power supply wiring.

Modification Example

Figure 13A:
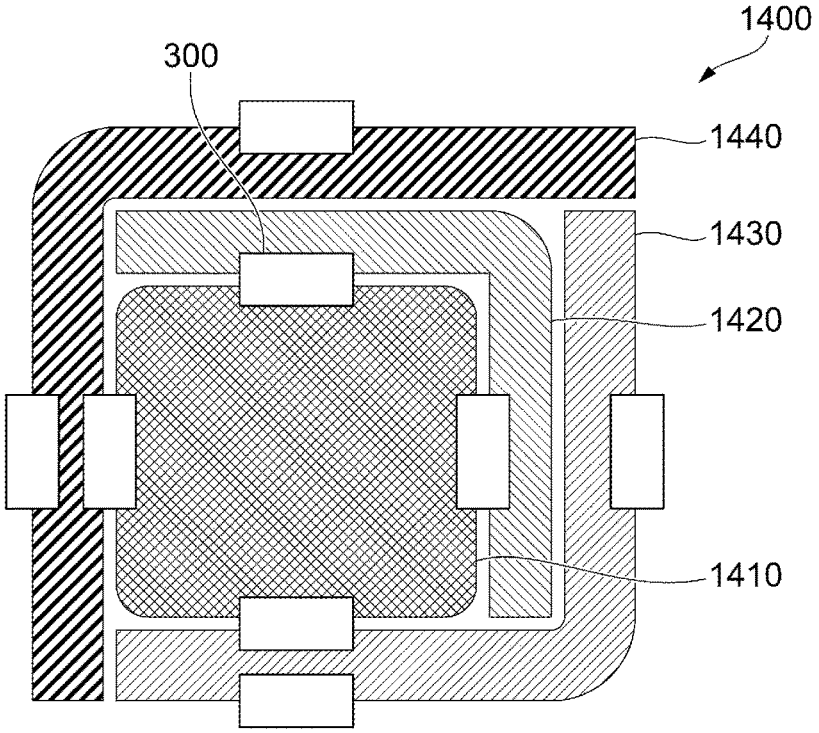
FIGS. 13A and 13B are diagrams illustrating a modification example.
Figure 13B:
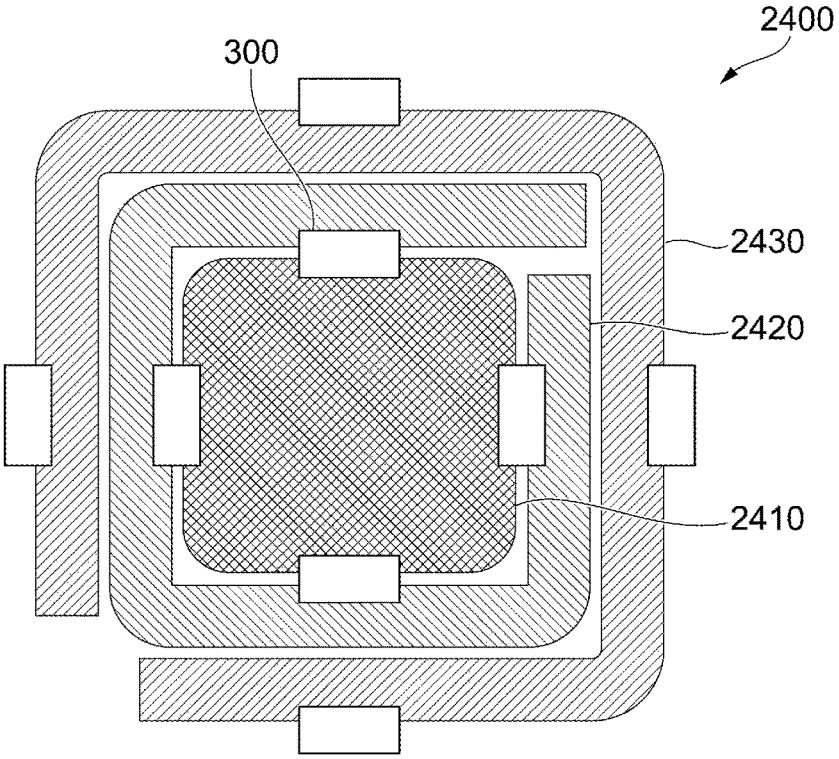

FIGS. 13A and 13B are diagrams illustrating a modification example.

Next, a modification example in the above exemplary embodiment will be described with reference to FIGS. 13A and 13B. In the following description, the same components as those of the above exemplary embodiments are denoted by the same reference numerals, and the description thereof is omitted in some cases.

First, in the exemplary embodiment described with reference to FIG. 10B, the first ground pattern 141 of the fourth layer 140 is surrounded by the first high power supply pattern 142 and the second high power supply pattern 143, which are two high power supply patterns, but the present invention is not limited thereto. For example, as in the fourth layer 1400 shown in FIG. 13A, the first ground pattern 1410 may be surrounded by three high power supply patterns. More specifically, the first ground pattern 1410 may be formed to face the first high power supply pattern 1420, the second high power supply pattern 1430, and the third high power supply pattern 1440.

In the exemplary embodiment described with reference to FIG. 10B, the first high power supply pattern 142 surrounds three sides of the first ground pattern 141, but the present invention is not limited thereto. For example, as in a fourth layer 2400 shown in FIG. 13B, a first high power supply pattern 2420 may surround four sides of a first ground pattern 2410. An illustrated second high power supply pattern 2430 surrounds four sides of the first high power supply pattern 2420.

Although an illustration is omitted, unlike the configuration in which the first high power supply pattern 142 and the second high power supply pattern 143, which are two types of high power supply patterns, are provided around the first ground pattern 141 as shown in FIG. 10B, when three or more types of high power supply patterns are provided, the configuration may be as follows. That is, a power supply pattern is arranged in which the operating frequency decreases from the central side toward the outside. In addition, other ground patterns are arranged outside the two power supply patterns surrounding the ground pattern, that is, the two types of power supply patterns. A pattern wiring surrounding the other ground pattern with another power supply pattern may be repeated.

Further, although the first ground pattern 141 described above has been described as having a substantially rectangular shape, the present invention is not limited thereto. For example, a recessed portion or a protruding portion may be provided in a part of the first ground pattern 141, or a corner portion may be curved. The first ground pattern 141 may be formed of a polygon having a pentagon or more. To further explain, for example, the first high power supply pattern 142 may cover three mutually adjacent sides of the first ground pattern 141 formed in a pentagonal shape, and the second high power supply pattern 143 may cover a side of the first ground pattern 141 not covered by the first high power supply pattern 142.

In the description of FIG. 10A, the first high power supply layer 131 and the second high power supply layer 135 are arranged in a nested manner, but the present invention is not limited thereto. For example, a recessed portion may be formed at one end of the first high power supply layer 131 and the second high power supply layer 135, and the other end may be disposed in the recessed portion.

In the description of FIG. 10B, the capacitor 310 is provided between the first ground pattern 141, the first high power supply pattern 142, the second high power supply pattern 143, the second ground pattern 144, and the PLL power supply pattern 145 in the fourth layer 140, but the capacitor 310 may not be provided therebetween.

Further, in the above description, the above configuration is provided in the board main body 150 composed of four layers, but the above configuration may be provided in a board main body having the number of layers other than four layers (not shown). For example, in a board main body having six or more layers (not shown), the above-described configuration may be provided in four of the six or more layers.

The control board 100 in the above description is an example of a board. The SoC 200 is an example of a semiconductor integrated circuit. The second surface 107 is an example of a back surface. The first ground pattern 141 is an example of a ground terminal. The first high power supply pattern 142 is an example of a large fluctuation terminal. The second high power supply pattern 143 is an example of a small fluctuation terminal. Among plural CPUs provided in the SoC 200 and having different operating frequencies, a CPU having a high operating frequency is an example of an element having a large transient current fluctuation, and a CPU having a low operating frequency is an example of an element having a small transient current fluctuation. The capacitor 310 is an example of a first capacitor and a second capacitor. The second ground pattern 144 is an example of another ground terminal. The PLL power supply pattern 145 is an example of another operation terminal. The first layer 110 is an example of a mounting layer. The second layer 120 is an example of a ground layer. The third layer 130 is an example of an operation layer. The fourth layer 140 is an example of a back layer. The notch 133 is an example of a recessed portion. The narrow portion 1352 is an example of a protruding portion. The PLL circuits provided in the SoC 200 are examples of other elements. The first high power supply layer 131 is an example of a high active layer. The second high power supply layer 135 is an example of a low active layer.

Although various exemplary embodiments and modification examples have been described above, these exemplary embodiments and modification examples may of course be combined.

In addition, the present disclosure is not limited to the above-described exemplary embodiments in any way, and can be implemented in various forms without departing from the scope of the present disclosure.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a board;

a semiconductor integrated circuit that is provided on the board and has a real-time clock circuit;

a radiator that is provided at a position for covering the semiconductor integrated circuit and receives heat from the semiconductor integrated circuit and radiates the heat; and an oscillator that is provided in a space sandwiched between the board and the radiator and vibrates to supply a clock signal to the real-time clock circuit.

2. The image forming apparatus according to claim 1, wherein an operation of the semiconductor integrated circuit is accompanied by variations in temperature occurring in the radiator, and the oscillator is provided at a position facing a low temperature region of the radiator in the space.

3. The image forming apparatus according to claim 2, wherein the board has a surface oriented in a vertical direction, and the oscillator is provided in a lower region of the space.

4. The image forming apparatus according to claim 3, wherein the radiator has a plurality of heat radiating portions placed side by side and extending in the vertical direction.

5. The image forming apparatus according to claim 2, further comprising:

an air flow generator that generates an air flow toward the radiator, wherein the oscillator is provided upstream in a direction of the air flow in the space.

6. The image forming apparatus according to claim 5, wherein the oscillator has a long shape in one direction, and is disposed to have a longitudinal direction intersecting the air flow.

7. The image forming apparatus according to claim 1, wherein the oscillator is provided on the board, and a gap is formed between the oscillator and the radiator.

8. The image forming apparatus according to claim 7, further comprising:

a limiting member that is sandwiched between the board and the radiator to limit a movement of the radiator toward the board.

9. The image forming apparatus according to claim 8, wherein a height of the oscillator from the board is smaller than a height of the semiconductor integrated circuit from the board.

10. The image forming apparatus according to claim 1, further comprising:

a capacitor that is connected to the semiconductor integrated circuit and the oscillator and is provided in the space.

11. The image forming apparatus according to claim 1, wherein the oscillator has a long shape in one direction, and the oscillator is disposed to have a longitudinal direction in a vertical direction.

12. A board comprising:

a board main body;

a semiconductor integrated circuit that is provided on the board main body and has a real-time clock circuit;

a radiator that is provided at a position for covering the semiconductor integrated circuit and receives heat from the semiconductor integrated circuit and radiates the heat; and an oscillator that is provided in a space sandwiched between the board main body and the radiator and vibrates to supply a clock signal to the real-time clock circuit.

* * * * *